US008890429B2

(12) United States Patent
Fukuda et al.

(10) Patent No.: US 8,890,429 B2
(45) Date of Patent: Nov. 18, 2014

(54) SOLID-STATE LIGHT-EMITTING ELEMENT DRIVE DEVICE, LIGHTING SYSTEM AND LIGHTING FIXTURE

(71) Applicant: Panasonic Corporation, Osaka (JP)

(72) Inventors: Kenichi Fukuda, Osaka (JP); Masahiro Naruo, Osaka (JP); Sana Esaki, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 14/022,369

(22) Filed: Sep. 10, 2013

(65) Prior Publication Data

US 2014/0077719 A1 Mar. 20, 2014

(30) Foreign Application Priority Data

Sep. 14, 2012 (JP) ..... 2012-202571
Sep. 14, 2012 (JP) ..... 2012-202572

(51) Int. Cl.
*H05B 33/08* (2006.01)

(52) U.S. Cl.
CPC ..... *H05B 33/08* (2013.01); *H05B 33/0815* (2013.01); *H05B 33/0887* (2013.01)
USPC ..... 315/224; 315/186; 315/209 R; 315/225; 315/291; 315/307

(58) Field of Classification Search
USPC ..... 315/186, 209 R, 224, 225, 246, 247, 315/291, 307, 308
See application file for complete search history.

(56) References Cited

U.S. PATENT DOCUMENTS

| | | | | |
|---|---|---|---|---|
| 6,847,169 | B2 | 1/2005 | Ito et al. | |
| 2004/0080273 | A1 | 4/2004 | Ito et al. | |
| 2012/0262087 | A1 * | 10/2012 | Watanabe et al. | 315/291 |
| 2013/0264964 | A1 * | 10/2013 | Luo et al. | 315/289 |

FOREIGN PATENT DOCUMENTS

| | | | |
|---|---|---|---|
| JP | 2004-134147 | A | 4/2004 |
| JP | 4236894 | B2 | 12/2008 |
| JP | 2010-263716 | A | 11/2010 |
| JP | 2012-004965 | A | 1/2012 |
| JP | 2012-014965 | A | 1/2012 |
| JP | 2012-023277 | A | 2/2012 |
| JP | 2012-084334 | A | 4/2012 |
| JP | 2012-094290 | A | 5/2012 |
| JP | 2012-104367 | A | 5/2012 |

* cited by examiner

*Primary Examiner* — Douglas W Owens
*Assistant Examiner* — Thai Pham
(74) *Attorney, Agent, or Firm* — Renner, Otto, Boisselle & Sklar, LLP

(57) ABSTRACT

A solid-state light-emitting element drive device includes a switching regulator and a control circuit. The switching regulator includes a series circuit of a switching element and an inductor, a regenerative element configured to allow a regenerative current to flow therethrough from the inductor when the switching element is turned off, and output terminals configured so that a solid-state light-emitting element is connected therebetween. The control circuit is configured to control a switching operation of the switching element of the switching regulator. The control circuit is configured to suppress an output power of the switching regulator if a parameter obtained from at least one of an ON-period and an OFF-period of the switching element is out of a prescribed range.

19 Claims, 17 Drawing Sheets

SOLID-STATE LIGHT-EMITTING ELEMENT DRIVE DEVICE, LIGHTING SYSTEM AND LIGHTING FIXTURE

TECHNICAL FIELD

The invention relates generally to solid-state light-emitting element drive devices, lighting systems and lighting fixtures, and more particularly, to a solid-state light-emitting element drive device configured to drive a solid-state light emitting device, such as a light emitting diode (LED) or an organic electroluminescence (EL) element, to emit light, and a lighting system and a lighting fixture that have the drive device.

BACKGROUND ART

Japanese Patent Application Publication No. 2010-263716A (hereinafter, referred to as "Document 1") discloses an example of a power device configured to drive a solid-state light-emitting element. This conventional device includes: a switching regulator including a smoothing capacitor in an output stage thereof; and connectors that are inserted between the smoothing capacitor and an LED module as a load to be detachably attached to each other, thereby detachably connecting the LED module with the smoothing capacitor. The connectors are designed to disconnect the smoothing capacitor from the switching regulator when the LED module is disconnected from the switching regulator by separating the connectors. The conventional device thereby therefore can avoid an excess voltage (no-load voltage) from being applied across the smoothing capacitor.

However, in the conventional device of the Document 1, there is a concern that an excess voltage is generated across the smoothing capacitor if the connectors are incompletely (incorrectly) connected with each other (so-called in a "loose-contact" state), because the smoothing capacitor is not completely disconnected from the switching regulator in this state. Then, if the connecters are connected completely (correctly) after the loose-contact state, the excess voltage (which is higher than the voltage in a normal state) generated across the smoothing capacitor is applied to the LED module, thereby causing an excess current to flow through the LED module.

In order to resolve the above problem, it may be considered to add a monitoring means for monitoring the output (voltage/current) of the drive device to detect presence of "a defect in connection" such as the loose-contact state and the no-load state. However, this configuration requires the monitoring means (such as a resistor) for monitoring the output (voltage/current) of the drive device, and therefore there is a problem that the circuit configuration becomes complex to cause an increase in production cost. In addition, in this configuration, part of the output of the switching regulator is dissipated by the monitoring means.

DISCLOSURE OF INVENTION

The present invention is developed in view of above problem, and it is an object of the invention to provide a solid-state light-emitting drive device which can reduce a failure caused by a defect in connection to a solid-state light-emitting element, with a simple circuit configuration.

A solid-state light-emitting element drive device of the invention includes a switching regulator and a control circuit. The switching regulator includes a series circuit of a switching element and an inductor, a regenerative element configured to allow a regenerative current to flow therethrough from the inductor when the switching element is turned off, and output terminals configured so that a solid-state light-emitting element is connected therebetween. The control circuit is configured to control a switching operation of the switching element of the switching regulator. The control circuit is configured to suppress an output power of the switching regulator if a parameter obtained from at least one of an ON-period and an OFF-period of the switching element is out of a prescribed range.

In one embodiment, the control circuit is configured: to turn off the switching element when an electric current through the switching element or the inductor is equal to or more than a predetermined peak value; and also to turn on the switching element when the regenerative current is equal to or less than a predetermined threshold. The control circuit is configured to suppress the output power of the switching regulator if a time period exceeds a prescribed upper limit. The time period is the switching element's ON period, OFF-period, or a switching cycle of the ON-period and the OFF period.

In one embodiment, the control circuit is configured to suppress the output power of the switching regulator if the current through the switching element or the inductor does not reach the peak value when the ON-period reaches the upper limit.

In one embodiment, the control circuit is configured not to terminate an operation of the switching regulator in a case where the OFF-period is in a predetermined range, even if the current through the switching element or the inductor does not reach the peak value when the ON-period reaches the upper limit.

In one embodiment, the control circuit is configured to suppress the output power of the switching regulator if the regenerative current does not reach the threshold when the OFF-period or the cycle reaches the upper limit.

In one embodiment, the solid-state light-emitting element drive device further includes a signal generation section configured to generate a PWM (pulse width modulation) signal. The PWM signal generated with the signal generation section is synchronized with a drive signal of the switching element.

In one embodiment, the control circuit is formed of a microcomputer including a built-in timer. The PWM signal is generated through the timer.

In one embodiment, the control circuit is configured to monitor temporal variations in ON-periods, OFF-periods, or cycles, by measuring the output of the timer, and to suppress the output power of the switching regulator if a value obtained from monitored values of the temporal variations exceeds a predetermined value.

In one embodiment, the control circuit is configured: to turn on the switching element when the regenerative current is equal to or less than a predetermined threshold; and also to turn off the switching element when a predetermined ON-time elapses or an electric current through the switching element is equal to or more than a predetermined peak value. The control circuit is configured to suppress the output power of the switching regulator if a ratio of the ON-period to the OFF-period is out of a prescribed range.

In one embodiment, the ON-period is a period of time during which the electric current through the inductor increases while the switching element is turned on. The OFF-period is a period of time during which the regenerative current decreases while the switching element is turned off.

In one embodiment, the control circuit is configured to decrease the ON-period or a rate of the ON-period if the ratio is out of the prescribed range.

In one embodiment, the control circuit is configured to determine whether or not the ratio is out of the prescribed range based on temporal variations in OFF-periods.

In one embodiment, the control circuit is configured to determine whether or not the ratio is out of the prescribed range based on temporal variations in ON-periods.

In one embodiment, the control circuit is configured not to determine whether or not the ratio is out of the prescribed range when an input voltage of the switching regulator is out of a predetermined range.

In one embodiment, the solid-state light-emitting element drive device further includes a signal generation section configured to generate a PWM (pulse width modulation) signal. The PWM signal generated with the signal generation section is synchronized with a drive signal of the switching element.

In one embodiment, at least one of the ON-period and the OFF-period substantially agrees with a high-level period or a low-level period of the PWM signal generated by the signal generation section. The control circuit is configured to determine whether or not the ratio is out of the prescribed range based on temporal variations in high-level periods or low-level periods.

In one embodiment, the control circuit is formed of a microcomputer including a built-in timer and configured to generate the PWM signal through the timer.

In one embodiment, the control circuit is configured to monitor the temporal variations in high-level periods or low-level periods, and to suppress the output power of the switching regulator if a value obtained from monitored values of the temporal variations exceeds a predetermined value.

A lighting system of the invention includes: the solid-state light-emitting element drive device; and a solid-state light-emitting element configured to be driven through the solid-state light-emitting element drive device.

A lighting fixture of the invention includes: the solid-state light-emitting element drive device; a solid-state light-emitting element configured to be driven through the solid-state light-emitting element drive device; and a fixture body holding the solid-state light-emitting element drive device and the solid-state light-emitting element.

According to the solid-state light-emitting element drive device, the lighting system and the lighting fixture of the invention, it is possible to reduce a failure caused by a defect in connection to a solid-state light-emitting element, with a simple circuit configuration.

DESCRIPTION OF EMBODIMENTS

Figure 1:
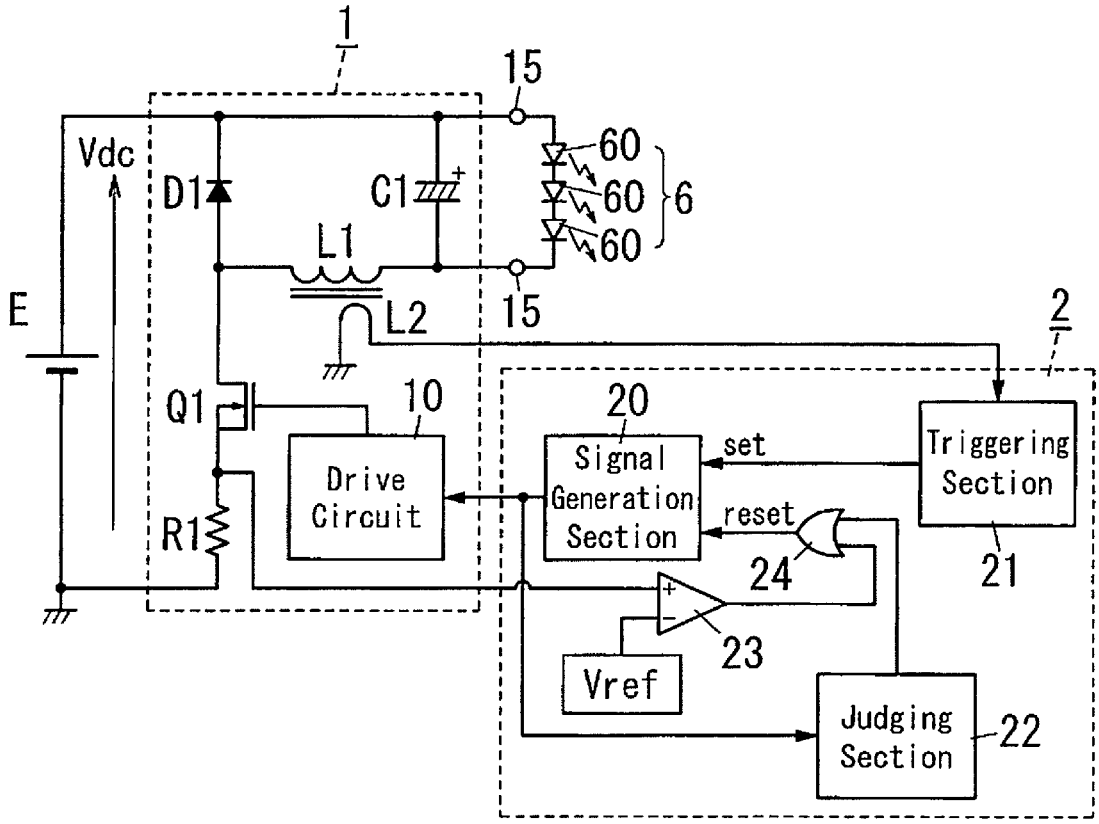
FIG. 1 is a circuit configuration diagram showing a solid-state light-emitting element drive device (an LED drive device) and a lighting system according to first embodiment of the invention.

Hereinafter, embodiments will be described, in which technical ideas of the invention are adapted to: a solid-state light-emitting element drive device (hereinafter, referred to as "an LED drive device") with an LED (a light-emitting diode) as a solid-state light-emitting element; a lighting system; and a lighting fixture. Note that, the solid-state light-emitting element is not limited to an LED, and may be other solid-state light-emitting element such as an organic electroluminescence (EL) element.

A solid-state light-emitting element drive device of the invention includes a switching regulator 1 and a control circuit 2. The switching regulator 1 includes a series circuit of a switching element Q1 and an inductor L1, a regenerative element (diode D1) configured to allow a regenerative current to flow therethrough (D1) from the inductor L1 when the switching element Q1 is turned off, and output terminals 15 (connector 5) configured so that a solid-state light-emitting element (light source 6) is connected therebetween (15). The control circuit 2 is configured to control a switching operation of the switching element Q1 of the switching regulator 1. The control circuit 2 is configured to suppress an output power of the switching regulator 1 if a parameter obtained from at least one of an ON-period Ton and an OFF-period Toff of the switching element Q1 is out of a prescribed range.

First Embodiment

An LED drive device and a lighting system of first embodiment are described with reference to FIGS. 1 to 3. As shown in FIG. 1, the lighting system of the embodiment includes: a light source 6; and the LED drive device. The light source 6 includes a plurality of LEDs 60 that are connected in series with each other. The LED drive device of the embodiment is configured to convert DC (direct-current) voltage/current supplied from a DC power source E into DC voltage/current according to the light source 6 to drive (light; power) the light source 6.

The LED drive device of the embodiment includes a switching regulator 1 and a control circuit 2. The light source 6 is connected between output terminals 15 of the switching regulator 1.

The DC power source E applies a DC voltage Vdc between input terminals of the switching regulator 1. The switching regulator 1 is formed of a well-known step-down chopper that includes a switching element Q1, a diode D1, an inductor L1, a smoothing capacitor C1, and a drive circuit 10. The switching element Q1 is a field-effect transistor (FET). The switching element Q1 has: a drain that is connected to an anode of the diode D1; and a source that is connected to a negative electrode of the DC power source E via a detection resistor R1. The inductor L1 has: a first end that is connected to a connection point of the anode of the diode D1 and the drain of the switching element Q1; and a second end that is connected to a low-voltage side terminal of the smoothing capacitor C1. The smoothing capacitor C1 is connected between the second end of the inductor L1 and a cathode of the diode D1. Both terminals of the smoothing capacitor C1 are respectively connected to the output terminals 15. A secondary winding L2 is provided so as to be electromagnetically coupled with the inductor L1. The secondary winding L2 has a first end that is connected to a circuit ground and a second end that is connected to an input port of the control circuit 2.

The drive circuit 10 turns on the switching element Q1 by applying a bias voltage to a gate of the switching element Q1 when a drive signal supplied from the control circuit 2 is at a high-level, and turns off the switching element Q1 by not applying the bias voltage when the drive signal is at a low-level.

The control circuit 2 includes a signal generation section (a PWM timer) 20 that generates a PWM (pulse width modulation) signal of which pulse width is variable. The signal generation section 20 of the embodiment is an RS flip flop. An output signal (the PWM signal) of the signal generation section 20 is, as the drive signal, supplied to the drive circuit 10. The control circuit 2 further includes a triggering section 21. The triggering section 21 is configured, when detecting a zero-cross of a voltage induced across the secondary winding L2 (i.e., detecting a zero-cross of an inductor current flowing through the inductor L1) via the input port, to transmit a signal with a high-level toward a set-terminal of the signal generation section 20 to switch the output signal (the drive signal) of the signal generation section 20 into the high-level.

The control circuit 2 further includes a comparator 23, a judging section 22, and an OR gate (a first OR gate) 24. The comparator 23 compares a voltage (detection voltage VR1) induced across the detection resistor R1 to a reference voltage Vref. The comparator 23 transmits a signal with a high-level when the detection voltage VR1 is larger than the reference voltage Vref. The judging section 22 is configured to measure a period (ON-period) of time during which the output signal of the signal generation section 20 is at the high-level and/or a period (OFF-period) of time during which the output signal of the signal generation section 20 is at the low-level, and to determine whether or not there is a defect in connection (i.e., whether or not the light source 6 is normally connected with the output terminals 15). The judging section 22 transmits a signal with a high-level when deciding presence of a defect in connection. The OR gate 24 calculates a logical add (OR) of output of the comparator 23 and output (judged result whether or not there is a defect in connection) of the judging section 22. That is, the OR gate 24 transmits a high-level signal to a reset-terminal of the signal generation section 20 when receiving a signal with the high-level from the comparator 23 and/or the judging section 22. When receiving the high-level signal from the OR gate 24 through the reset-terminal, the signal generation section 20 switches its own output signal into the low-level.

Figure 3:
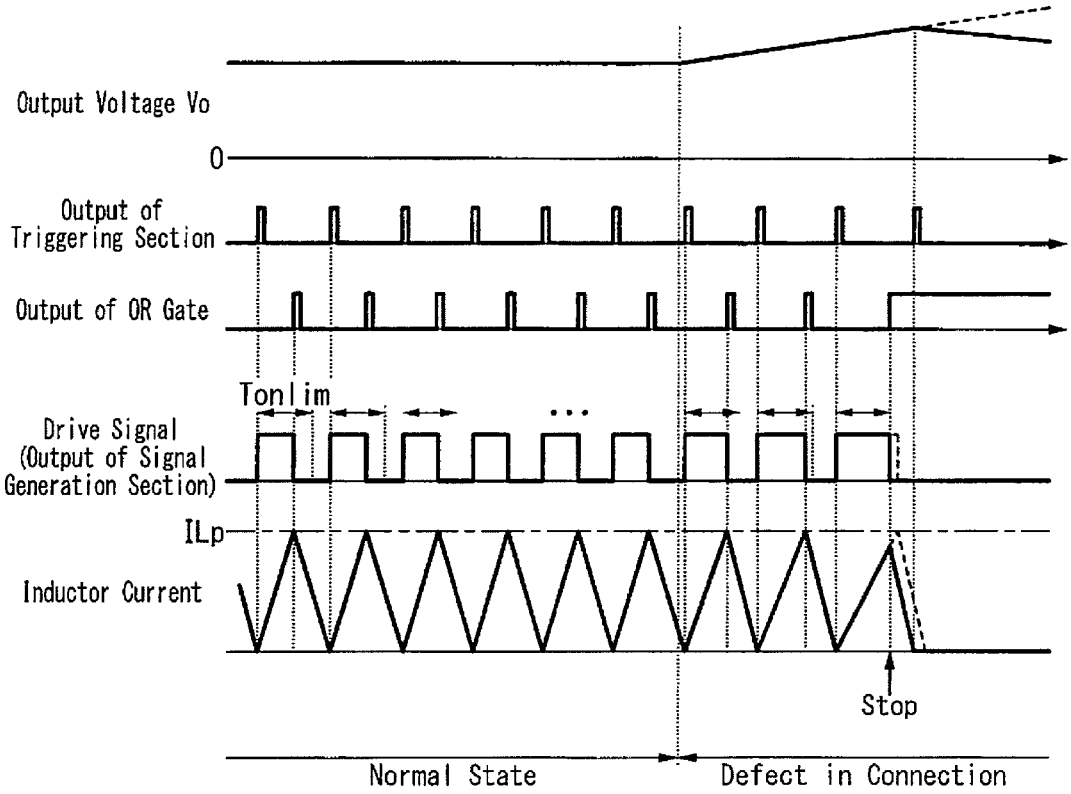
FIG. 3 is a time chart for illustrating an operation of the solid-state light-emitting element drive device and the lighting system according to the first embodiment.

Therefore, the control circuit 2 is configured to control the switching element Q1 according to so-called "critical current mode", in which the control circuit 2 turns off the switching element Q1 when a current flowing through the switching element Q1 (an inductor current flowing through the inductor L1) increases to reach a predetermined peak value ILp, and turns on the switching element Q1 when all the energy stored in the inductor L1 during an ON-period of the switching element Q1 is emitted (see FIG. 3). The ON-period Ton is a variable period of time depending on the peak value ILp (and an upper limit Ibnim described below).

The judging section 22 of the embodiment measures an ON-period (a period of time during which the drive signal is at the high-level) of the switching element Q1, and switches the output signal (which is transmitted toward the OR gate 24) from the low-level into the high-level when the measured ON-period Ton exceeds a prescribed upper limit (threshold) Tonlim. Therefore, if an ON-period Ton of the switching element Q1 exceeds the upper limit Tonlim, the output of the OR gate 24 is fixed (kept) at the high-level, regardless of the level of the output of the comparator 23, and accordingly the output signal of the signal generation section 20 is fixed (kept) at the low-level. As a result, the drive signal transmitted to the drive circuit 10 is fixed (kept) at the low-level, and thereby the switching element Q1 is kept turned off to terminate the operation of the switching regulator 1.

Figure 2:
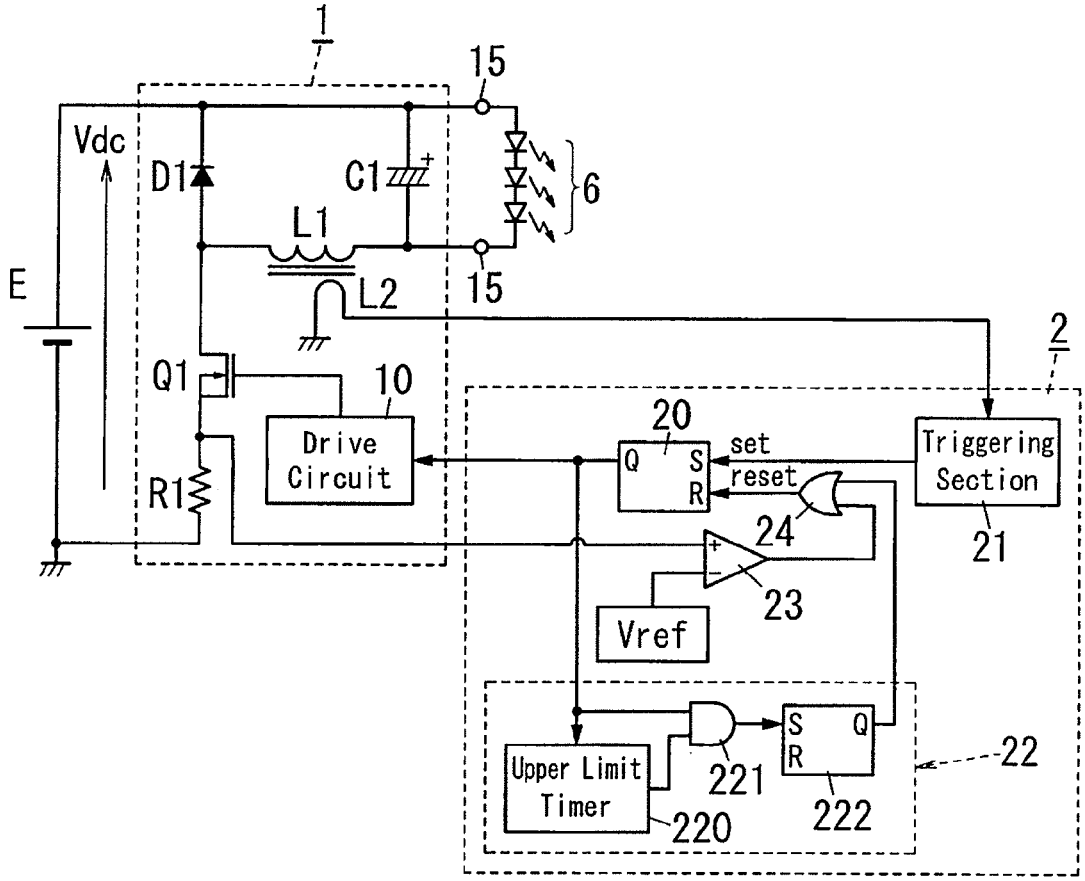
FIG. 2 is a circuit diagram showing the solid-state light-emitting element drive device and the lighting system according to the first embodiment.

FIG. 2 illustrates a specific example of the judging section 22. The judging section 22 includes an upper limit timer 220, an AND gate (a first AND gate) 221, and a latch circuit 222 of an RS flip flop. The upper limit timer 220 is formed of, for example, a delay circuit having a delay time that is equal to the upper limit Tonlim of the ON-period Ton. The AND gate 221 calculates a logical product (AND) of the output signal of the signal generation section 20 and output signal of the upper limit timer 220, and transmits a calculated result toward a set-terminal of the latch circuit 222.

A control operation of the switching regulator 1 by the control circuit 2 will be described with reference to FIG. 3.

The upper limit timer 220 is configured to maintain the output signal thereof at a low-level until the delay time (which is equal to the upper limit Tonlim) elapses from a point in time when the driving signal is raised into the high-level, and to switch the output signal thereof into a high-level if the delay time elapses. In this regard, if the drive signal is lowered into the low-level before the delay time elapses, the upper limit timer 220 is reset. Therefore, the output of the upper limit timer 220 is kept at the low-level in a case where the light source 6 is normally (correctly) connected to the output terminals 15, because the current through the switching element Q1 increases to reach the peak value ILp before the delay time elapses (i.e., before an ON-period Ton reaches the upper limit Tonlim). The output of the AND gate 221 is therefore kept at a low-level, and one of two inputs of the OR gate 24 is latched (locked) at the low-level by the latch circuit 222. Accordingly, the drive signal is switched between the high-level and the low-level in response to the other of two inputs of the OR gate 24 i.e., in response to the level of the output of the comparator 23. As a result, the switching element Q1 is turned on and off by the drive circuit 10, and thereby the light source 6 is supplied with a desired voltage/current from the switching regulator 1.

The peak value "ILp" of the inductor current is expressed in the formula below:

$$ILp=Ton*(Vdc-Vo)/L \quad \text{(Formula 1)},$$

where "L" denotes an inductance of the inductor L1, "Vo" denotes an output voltage of the switching regulator 1, "Vdc" denotes the input voltage of the switching regulator 1 (corresponding to the output voltage of the DC power source E), and "Ton" denotes the ON-period of the switching element Q1.

By deforming the (Formula 1), it is obtained the formula below:

$$Ton=(L*ILp)/(Vdc-Vo) \quad \text{(Formula 2)}.$$

The output voltage Vo of the switching regulator 1 is, usually, equivalent to a rated voltage (=product of "a forward voltage of an LED 60" and "the number of the LED 60") of the light source 6, and is kept constant under a condition where the light source 6 is supplied with a constant current. Accordingly, by setting a high-level period of the output signal (drive signal) of the signal generation section 20 to a specified ON-period Ton obtained by the (Formula 2), it is possible to obtain a desired output voltage Vo and output current Io from the switching regulator 1. As is understood from the (Formula 2), the ON-period Ton is kept substantially constant in a case where the light source 6 is correctly connected between the output terminals 15 of the switching regulator 1 and the light source 6 has no bad condition such as a short circuit.

On the other hand, if the light source 6 is disconnected from the output terminals 15 (no-load state) or the light source 6 is incompletely connected to the output terminals 15 (loose-contact state), it causes an increase in the output voltage Vo of the switching regulator 1. In such the state (i.e., in a state of a defect in connection), the ON-period Ton of the switching element Q1 becomes longer as compared to a case where the light source 6 is correctly connected, because the control circuit 2 keeps the switching element Q1 turned on until the detection voltage VR1 inputted into the comparator 23 exceeds the reference voltage Vref.

In this regard, the control circuit 2 of the embodiment includes the upper limit timer 220 which is configured to transmit a delayed signal at a point in time when the delay time (=upper limit Tonlim) elapses after an output signal (a drive signal) of the signal generation section 20 is raised, and decides presence of a defect in connection and to terminate the operation of the switching element Q1 if an ON-period Ton of the output signal exceeds the delay time (=upper limit Tonlim). That is, if an ON-period Ton exceeds the upper limit Tonlim, the output of the upper limit timer 220 is raised into the high-level, the output of the AND gate 221 is raised into the high-level, and the output of the latch circuit 222 is raised into (and kept at) the high-level. As a result, the output of the OR gate 24 is kept at the high-level regardless of the level of the output of the comparator 23, and accordingly the output signal of the signal generation section 20 is kept at the low-level to terminate the operation of the switching regulator 1. It is therefore possible to suppress an increase in the output voltage Vo of the switching regulator 1.

As described above, in the embodiment, the control circuit 2 is configured: to turn off the switching element Q1 when the inductor current through the inductor L1 (the electric current through the switching element Q1) is equal to or more than a predetermined peak value ILp; and also to turn on the switching element Q1 when the regenerative current is equal to or less than a predetermined threshold. The control circuit 2 is configured to suppress the output power of the switching regulator 1 if an ON-period Ton exceeds a prescribed upper limit Tonlim. In detail, the control circuit 2 is configured to suppress the output power of the switching regulator 1 if the inductor current through the inductor L1 (electric current through the switching element Q1) does not reach the peak value ILp when the ON-period Ton reaches the upper limit Tonlim. Note that, the control circuit 2 may be formed of a microcomputer with a timer.

With regard to a method of suppressing the output power of the switching regulator 1, the control circuit 2 is not limited to a configuration of terminating the operation of the switching element Q1. For example, the control circuit 2 may be configured to decrease the reference voltage Vref of the comparator 23 to reduce the peak value ILp.

As described above, the control circuit 2 of the embodiment is configured to control the switching element Q1 according to the critical current mode. However, the control circuit 2 is not limited to this configuration, and may be configured to control the switching element Q1 according to "continuous current mode" or "discontinuous current mode".

According to the continuous current mode, the triggering section 21 raise the output thereof into the high-level when the induced voltage across the secondary winding L2 decreases to reach a predetermined threshold (>0), thereby turning on the switching element Q1 before the inductor current reaches "0". In this configuration, the ON-period Ton of the switching element Q1 is expressed in a formula below:

$$Ton=L*(ILp-ILb)/(Vdc-Vo) \quad \text{(Formula 3)},$$

where "ILb" (>0) denotes a lower limit (which corresponds to the inductor current when the induced voltage equals to the threshold described above) of the inductor current.

As is understood from the (Formula 3), the ON-period Ton is kept substantially constant in a case where the light source 6 is correctly connected between the output terminals 15 of the switching regulator 1 and the light source 6 has no bad condition such as a short circuit. Therefore, by setting the upper limit Tonlim of the ON-period adequately, it is possible to determine whether or not there is a defect in connection, as similar with the case of the critical current mode.

In the continuous current mode, the control circuit 2 may be configured to raise the output signal of the signal generation section 20 into the high-level at a point in time when a predetermined time elapses after the output signal of the signal generation section 20 is lowered into the low-level (note that, in this configuration, the OFF-period Toff is kept constant). In this configuration, the OFF-period Toff of the switching element Q1 satisfies the formula below:

$$Toff<Vo/(L*ILp) \quad \text{(Formula 4)}.$$

In this configuration, the lower limit ILb of the inductor current is expressed in the formula below:

$$ILb=ILp-Toff*Vo/L \quad \text{(Formula 5)}.$$

By substituting the (Formula 5) into the (Formula 3) and deforming the obtained formula, it is obtained the formula below:

$$Ton=Toff*Vo/(Vdc-Vo) \quad \text{(Formula 6).}$$

As is understood from the (Formula 6), in the configuration of a constant OFF-period Toff, the ON-period Ton increases with an increase in the output voltage Vo. Accordingly, it is possible to detect presence of a defect in connection by comparing an ON-period Ton with the upper limit Tonlim.

According to the discontinuous current mode, although the OFF-period Toff of the switching element Q1 satisfies the formula below:

$$Toff>Vo/(L*ILp) \quad \text{(Formula 7)}$$

in contrast to the critical current mode, the ON-period Ton is expressed in the (Formula 2) as with the critical current mode.

Accordingly, it is possible to detect presence of a defect in connection by comparing an ON-period Ton with the upper limit Tonlim, as similar with the critical current mode and the continuous current mode.

Second Embodiment

A lighting system and an LED drive device of second embodiment are described with reference to FIGS. 2 and 4 to 6. The LED drive device and the lighting system according to the embodiment have a similar circuit configuration with the first embodiment, and therefore like elements are assigned the same reference signs as depicted in the first embodiment and not illustrated and described in detail.

A control circuit 2 of the embodiment is configured to measure an OFF-period (a period of time during which the drive signal is at a low-level) of a switching element Q1. The control circuit 2 is configured to keep the switching element Q1 turned off to terminate the operation of a switching regulator 1 if a measured OFF-period Toff exceeds a prescrobed upper limit (threshold) Tofflim.

In a case where the control circuit 2 controls a switching element Q1 according to the critical current mode, an OFF-period Toff of the switching element Q1 and a peak value ILp of an inductor current satisfies the formula below:

$$0=ILp-Toff*Vo/L \quad \text{(Formula 8).}$$

By deforming the (Formula 8), the OFF-period Toff is expressed in the formula below:

$$Toff=(L*ILp)/Vo \quad \text{(Formula 9)}$$

If there is no defect in connection (i.e., if a light source 6 is correctly connected to output terminals 15), the peak value ILp is kept constant and the output voltage Vo of the switching regulator 1 is also kept constant, and accordingly the OFF-period Toff is kept constant as is understood from the (Formula 9).

Figure 4:
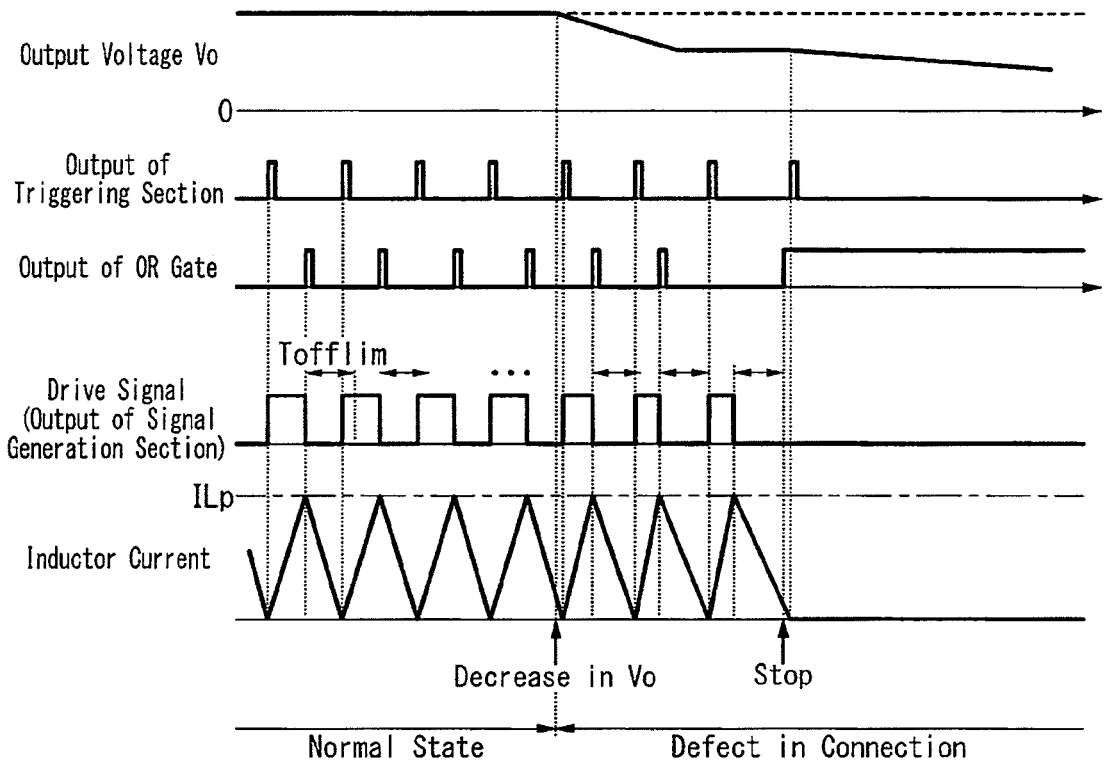
FIG. 4 is a time chart for illustrating an operation of a solid-state light-emitting element drive device (an LED drive device) and a lighting system according to second embodiment of the invention.

On the other hand, if a short circuit occurs between the output terminals 15 and/or an impedance across the output terminals 15 decreases with respect to a normal condition due to malfunction of the light source 6, it causes a decrease in the output voltage Vo of the switching regulator 1 (see FIG. 4). As is understood from the (Formula 9), the OFF-period Toff increases with a decrease in the output voltage Vo.

In this regard, the control circuit 2 of the embodiment includes an upper limit timer 220 which is configured to transmit a delayed signal at a point in time when a delay time (=upper limit Tofflim) elapses after an output signal (a drive signal) of a signal generation section 20 is lowered, and decides presence of a defect in connection to terminate the operation of the switching element Q1 if an OFF-period Toff of the output signal exceeds the delay time (=upper limit Tofflim). That is, if an OFF-period Toff exceeds the upper limit Tofflim, output of the upper limit timer 220 is raised into a high-level, output of an AND gate 221 is raised into a high-level, and output of a latch circuit 222 is raised into (and kept at) a high-level. As a result, output of an OR gate 24 is kept at a high-level regardless of the level of output of a comparator 23, and accordingly the output signal of the signal generation section 20 is kept at a low-level to terminate the operation of the switching regulator 1 (see FIG. 4).

As described above, in the embodiment, the control circuit 2 is configured: to turn off the switching element Q1 when the inductor current through an inductor L1 (electric current through the switching element Q1) is equal to or more than a predetermined peak value ILp; and also to turn on the switching element when the regenerative current is equal to or less than a predetermined threshold. The control circuit is configured to suppress the output power of the switching regulator 1 if an OFF-period Toff exceeds a prescribed upper limit Tofflim. In detail, the control circuit 2 of the embodiment is configured to suppress the output power of the switching regulator 1 if the regenerative current does not reach the threshold when the OFF-period Toff reaches the upper limit Tofflim. According to the embodiment, it is possible to detect presence of a defect in connection without adding a monitoring means monitoring the output (voltage/current) of the switching regulator 1.

In a case where the control circuit 2 controls the switching element Q1 according to the critical current mode, a switching cycle T (of an ON-period Ton and an OFF-period Toff) is expressed in the formula below:

$$T=Ton+Toff=L*ILp*\{1/(Vdc-Vo)+1/Vo\}=L*ILp*Vdc/\{(Vdc-Vo)*Vo\} \quad \text{(Formula 10).}$$

By assuming that the output voltage Vo is expressed in the formula: "Vo=k*Vdc" using a factor "k", the (Formula 10) is deformed to the formula below:

$$T=L*ILp/\{k*(1-k)*Vdc\} \quad \text{(Formula 11).}$$

By normalizing the cycle "Tx" that is a cycle T in a case that the factor k=½ (i.e., Tx=(4*L*ILp)/Vdc=1), the cycle "T" is expressed in the formula below:

$$T=Tx/\{4*k*(1-k)\}=1/\{4*k*(1-k)\} \quad \text{(Formula 12).}$$

Figure 5:
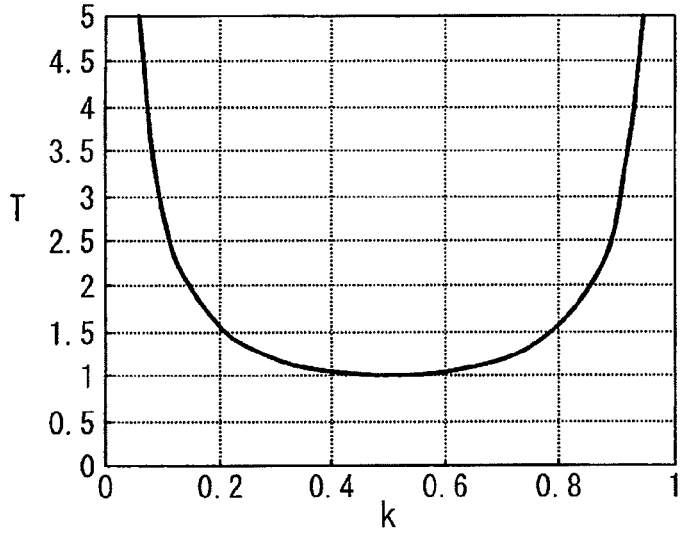
FIG. 5 is a graph for illustrating a characteristic of the solid-state light-emitting element drive device and the lighting system according to the second embodiment.
Figure 6:
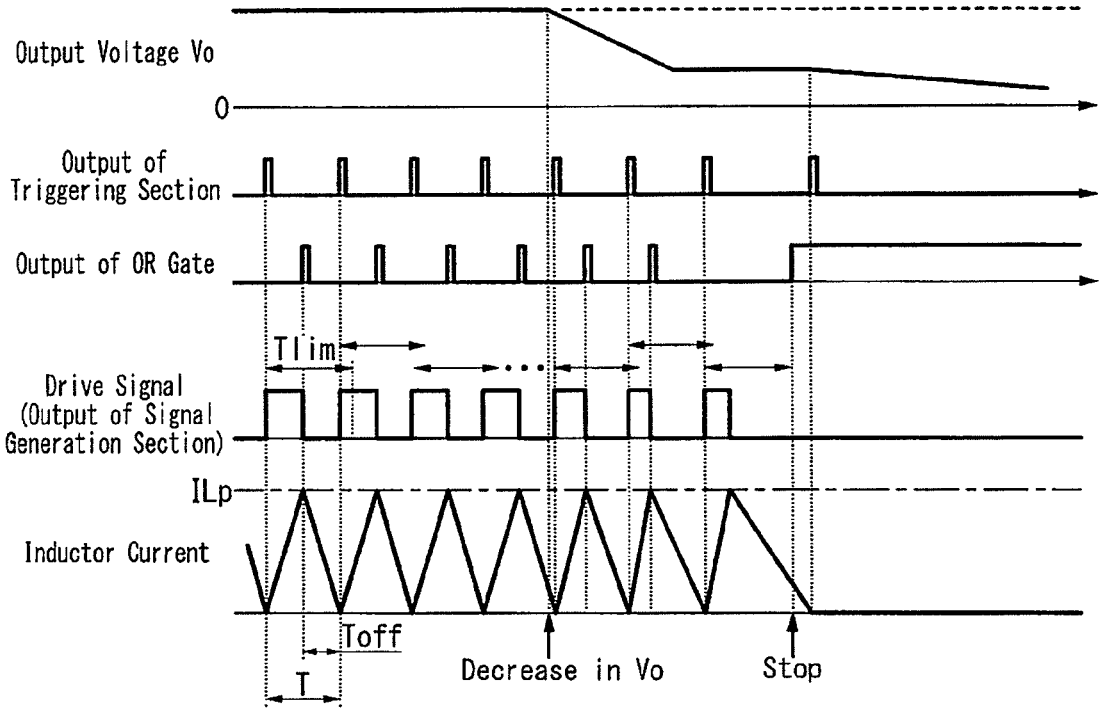
FIG. 6 is a time chart for illustrating an operation of the solid-state light-emitting element drive device and the lighting system according to the second embodiment.

FIG. 5 shows the a of the (Formula 12). As is understood from FIG. 5, the cycle T sharply increases as the factor k approaches "0" due to a decrease in the output voltage Vo caused by, for example, a decrease in the impedance of the light source 6. Accordingly, by measuring the cycle T through a judging section 22 and comparing the measured cycle T with an upper limit (threshold) Tlim, it is possible to detect presence of a defect in connection (see FIG. 6).

That is, the control circuit 2 may be configured to suppress the output power of the switching regulator 1 if the switching cycle T of the ON-period Ton and the OFF-period Toff exceeds a prescribed upper limit Tlim. In detail, the control circuit 2 may be configured to suppress the output power of the switching regulator 1 if the regenerative current does not reach the threshold when the cycle T reaches the upper limit Tlim.

Note that, in the embodiment, the switching element Q1 may be controlled in the continuous current mode or the discontinuous current mode.

According to the continuous current mode, a lower limit ILb of the inductor current is expressed in the formula below:

$$ILb=ILp-Toff*Vo/L \quad \text{(Formula 13).}$$

By deforming the (Formula 13), it is obtained the formula below:

$$Toff=L*(ILp-ILb)/Vo \quad \text{(Formula 14).}$$

As is understood from the (Formula 14), the OFF-period Toff is kept substantially constant in a case where the light source 6 is correctly connected between the output terminals 15 of the switching regulator 1 and the light source 6 has no bad condition such as a short circuit. Therefore, by setting the upper limit Tofflim of the OFF-period adequately, it is possible to determine whether or not there is a defect in connection, as similar with the case of the critical current mode.

According to the discontinuous current control mode, it is possible to determine whether or not there is a defect in connection by: measuring a period of time for decreasing the inductor current from the peak value ILp to "0"; and comparing the measured period with a prescribed upper limit.

Third Embodiment

A lighting system and an LED drive device of third embodiment are described with reference to FIGS. 7 and 8. In the LED drive device and the lighting system of the embodiment, a switching regulator 1 is supplied with a DC voltage Vdc from a DC power section which is configured to convert an AC (alternate-current) voltage Vin of a commercial AC source 100 into the DC voltage Vdc. The DC power section includes an AC-DC converter 4 such as a well-known boost chopper, and a smoothing capacitor C0 is connected between output terminals of the AC-DC converter 4.

The first and second embodiments are described under the premise that a DC power source E supplies a switching regulator 1 with a sufficiently stable DC voltage Vdc. However, in the configuration of obtaining the DC voltage Vdc by converting the AC voltage Vin of a commercial AC power source 100 by means of the AC-DC converter 4 and the smoothing capacitor C0, there is a concern that the DC voltage Vdc includes a fluctuation due to a ripple component of which frequency is twice the power-supply frequency of the AC voltage source 100. In addition, if the AC input voltage Vin fluctuates within a short time, there is a possibility that the DC voltage Vdc also fluctuates within a short time according to responsiveness of the AC-DC converter 4. If the DC voltage Vdc has a fluctuation component, an ON-period Ton of a switching element Q1 also fluctuates, as is understood from the (Formula 3). In this case, there is a concern that a control circuit 2 makes a wrong decision of presence of a defect in connection.

In this regard, if there is no defect in connection (i.e., if a light source 6 is correctly connected to output terminals 15) and the output voltage Vo of a switching regulator 1 is kept constant, an OFF-period Toff is kept constant as is understood from the (Formula 9). Therefore, in the embodiment, if an OFF-period Toff has little fluctuation, the control circuit 2 is configured to judge not as "presence of a defect in connection" but as "presence of a fluctuation (reduction) of output voltage Vdc of the DC power section" even if an ON-period Ton reaches the upper limit Tonlim.

Figure 7:
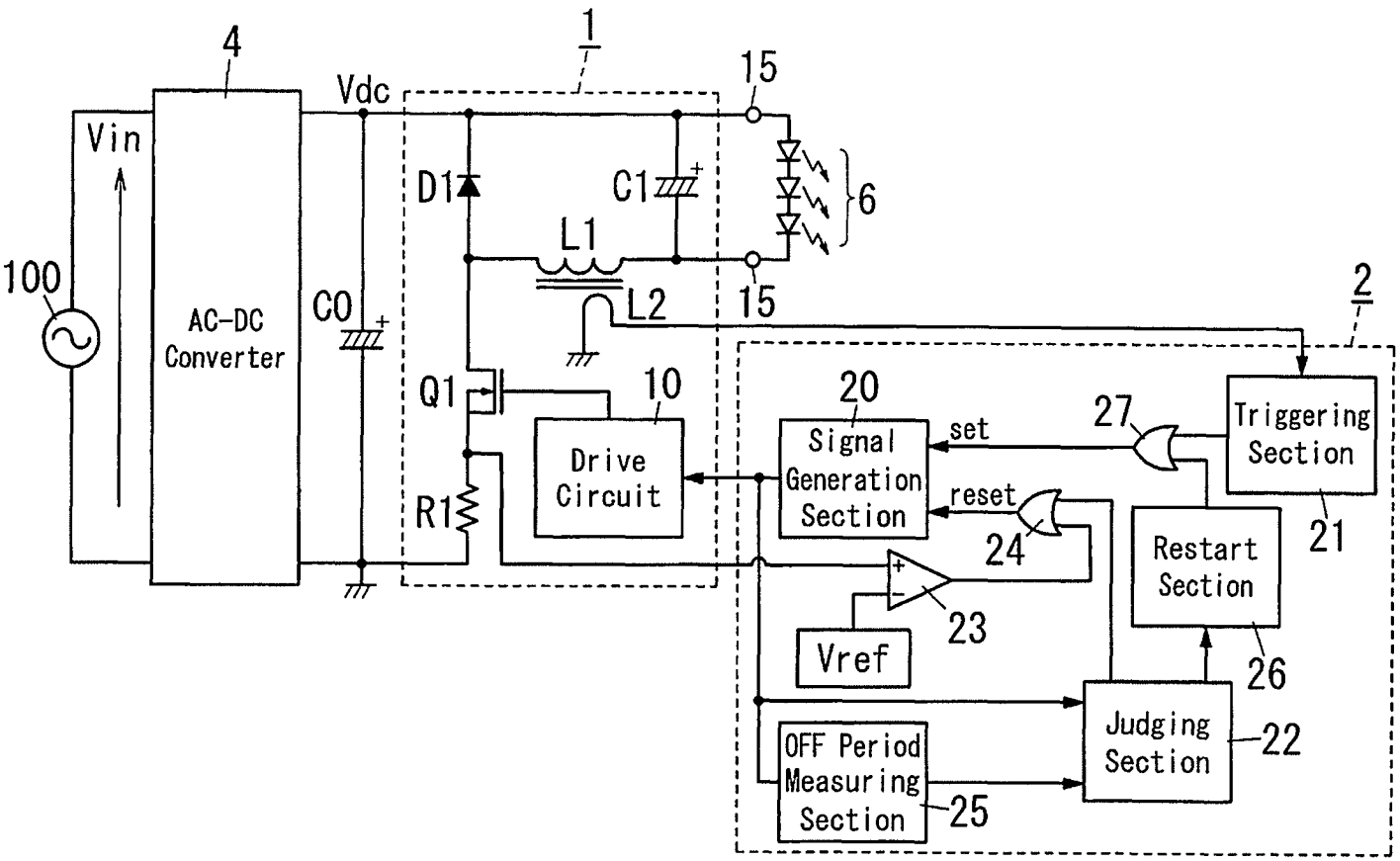
FIG. 7 is a circuit configuration diagram showing a solid-state light-emitting element drive device (an LED drive device) and a lighting system according to third embodiment of the invention.
Figure 8:
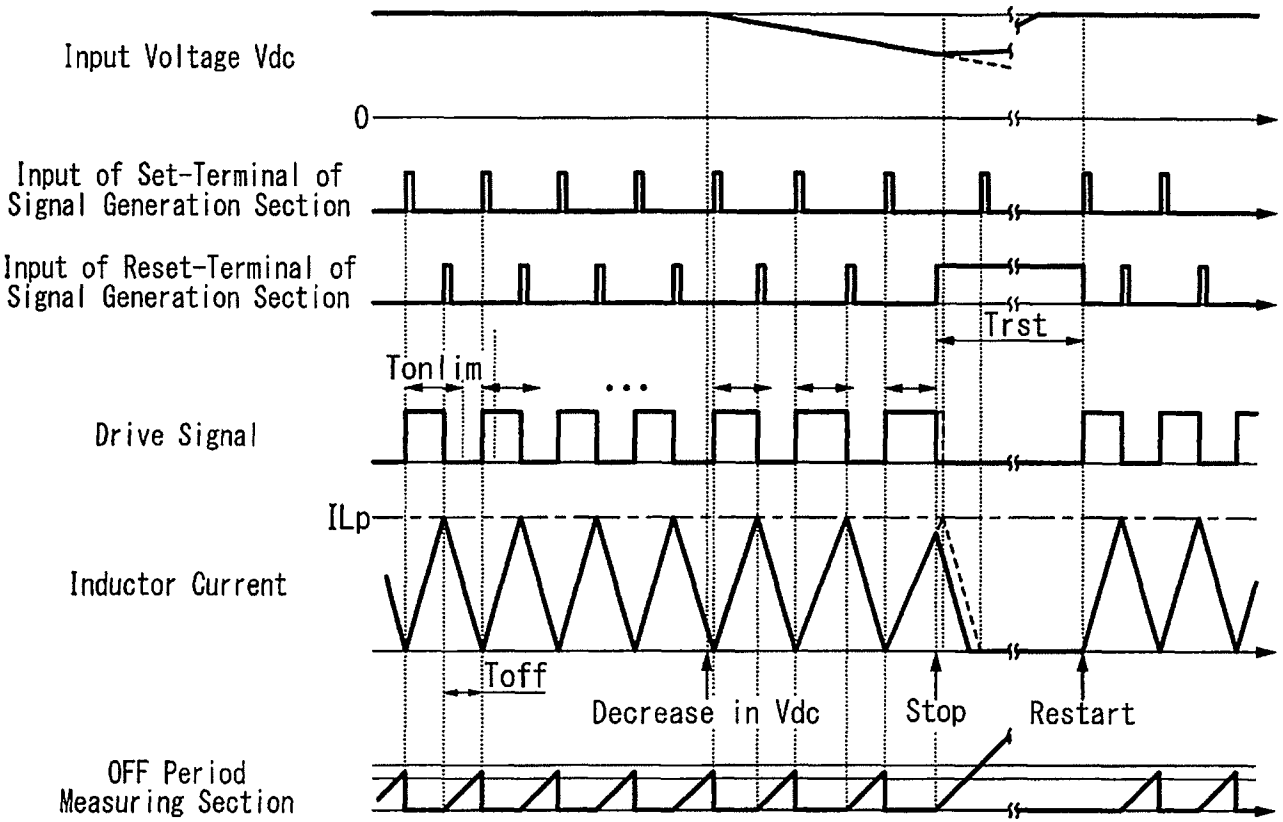
FIG. 8 is a time chart for illustrating an operation of the solid-state light-emitting element drive device and the lighting system according to the third embodiment.

In the embodiment, as shown in FIG. 7, the control circuit 2 further includes an OFF period measuring section 25 which receives an output signal of a signal generation section 20 to measure the OFF-period Toff. When detecting that an ON-period Ton reaches the upper limit Tonlim, a judging section 22 determines whether or not a fluctuation, obtained by the measured OFF-periods Toff during the latest some cycles with the OFF period measuring section 25, of the OFF-period Toff is in a predetermined range. If detecting that the fluctuation of the OFF-period Toff is out of the predetermined range, the judging section 22 decides that there is a defect in connection, and transmits a signal with a high-level toward an OR gate 24 to terminate the operation of the switching regulator 1.

On the other hand, in the embodiment, the control circuit 2 interrupts and then restarts (i.e., not to terminate) the operation of the switching regulator 1 if the fluctuation of the OFF-period Toff is in the predetermined range. In detail, if the fluctuation of the OFF-period Toff is in the predetermined range, the judging section 22 decides that there is a reduction of the output voltage Vdc of the DC power section, and lowers the output signal toward the OR gate 24 into a low-level at a point in time when a predetermined restart time Trst elapses after the output signal toward the OR gate 24 is raised into the high-level (see FIG. 8). When the restart time Trst elapses, the judging section 22 also transmits a signal with the high-level toward a restart section 26. The restart section 26 transmits a one-shot pulse (restart signal) when receiving the signal with the high-level from the judging section 22 (see FIG. 8). An OR gate (a second OR gate) 27 calculates a logical added (OR) of the restart signal and an output signal of a triggering section 21. Therefore, when the restart signal is inputted into the OR gate 27, a set-terminal of the signal generation section 20 is supplied with a high-level signal, and accordingly an output signal of the signal generation section 20 is raised into a high-level regardless of the level of the output signal of the triggering section 21. As a result, the drive circuit 10 turns on the switching element Q1 to restart the switching regulator 1 (see FIG. 8).

As described above, in the embodiment, the control circuit 2 does not terminate the operation of the switching regulator 1 in a case where an OFF-period Toff is in a predetermined range, even if an inductor current does not reach the peak value ILp when an ON-period Ton reaches the upper limit Tonlim. Accordingly, it is possible to prevent the switching regulator 1 from being wrongly halted for a long time due to a wrong decision made by the control section 2 about presence of a defect in connection caused by a fluctuation of the input voltage Vdc of the switching regulator 1. Note that, the control section 2 may be configured to measure an ON-period Ton and a switching cycle T to calculate an OFF-period Toff, instead of measuring an OFF-period Toff.

Fourth Embodiment

A lighting system and an LED drive device of fourth embodiment are described with reference to FIGS. 9 and 10. The LED drive device and the lighting system according to the embodiment have a similar circuit configuration with the third embodiment, and therefore like elements are assigned the same reference signs as depicted in the third embodiment and not described in detail.

Figure 9:
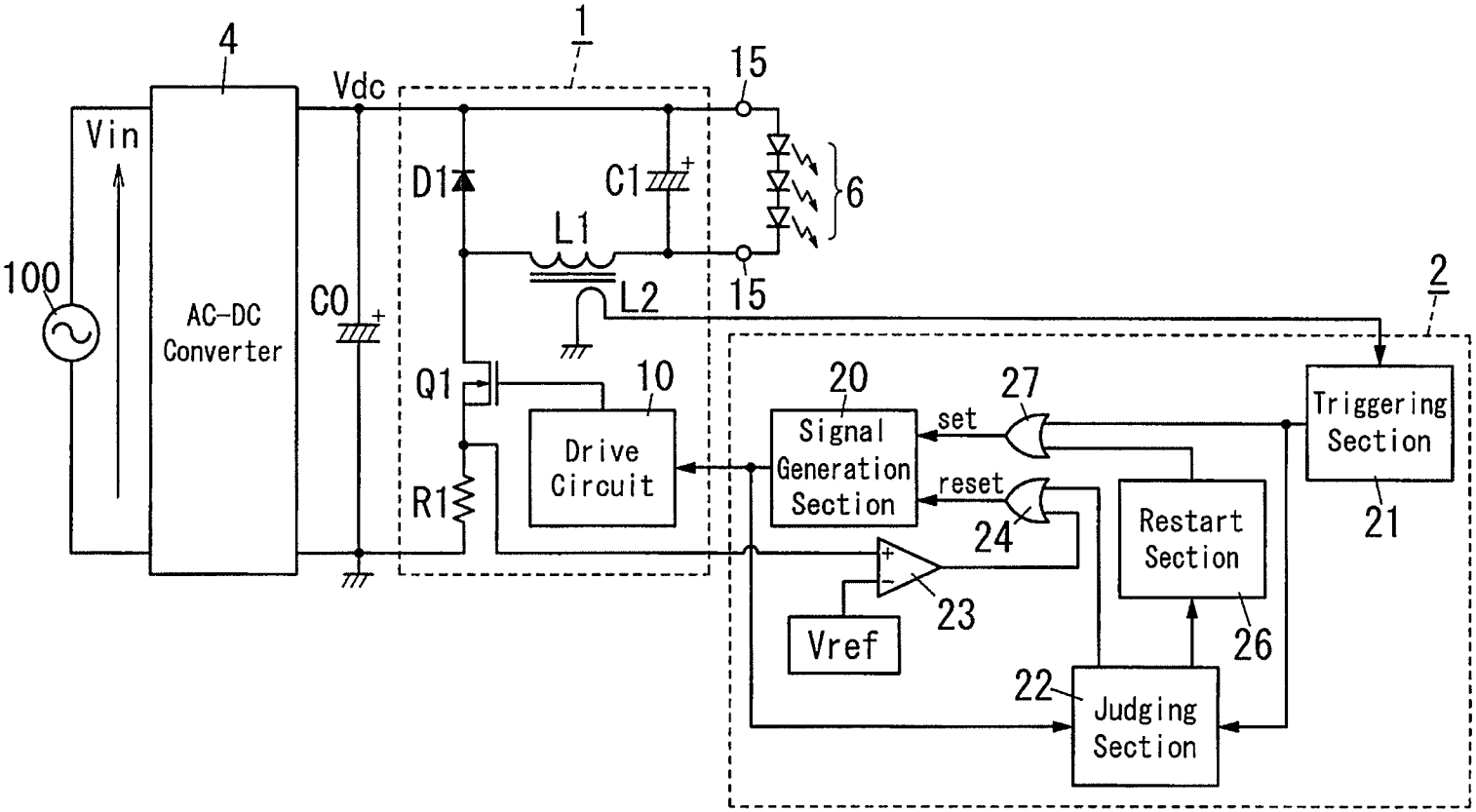
FIG. 9 is a circuit configuration diagram showing a solid-state light-emitting element drive device (an LED drive device) and a lighting system according to fourth embodiment of the invention.
Figure 10:
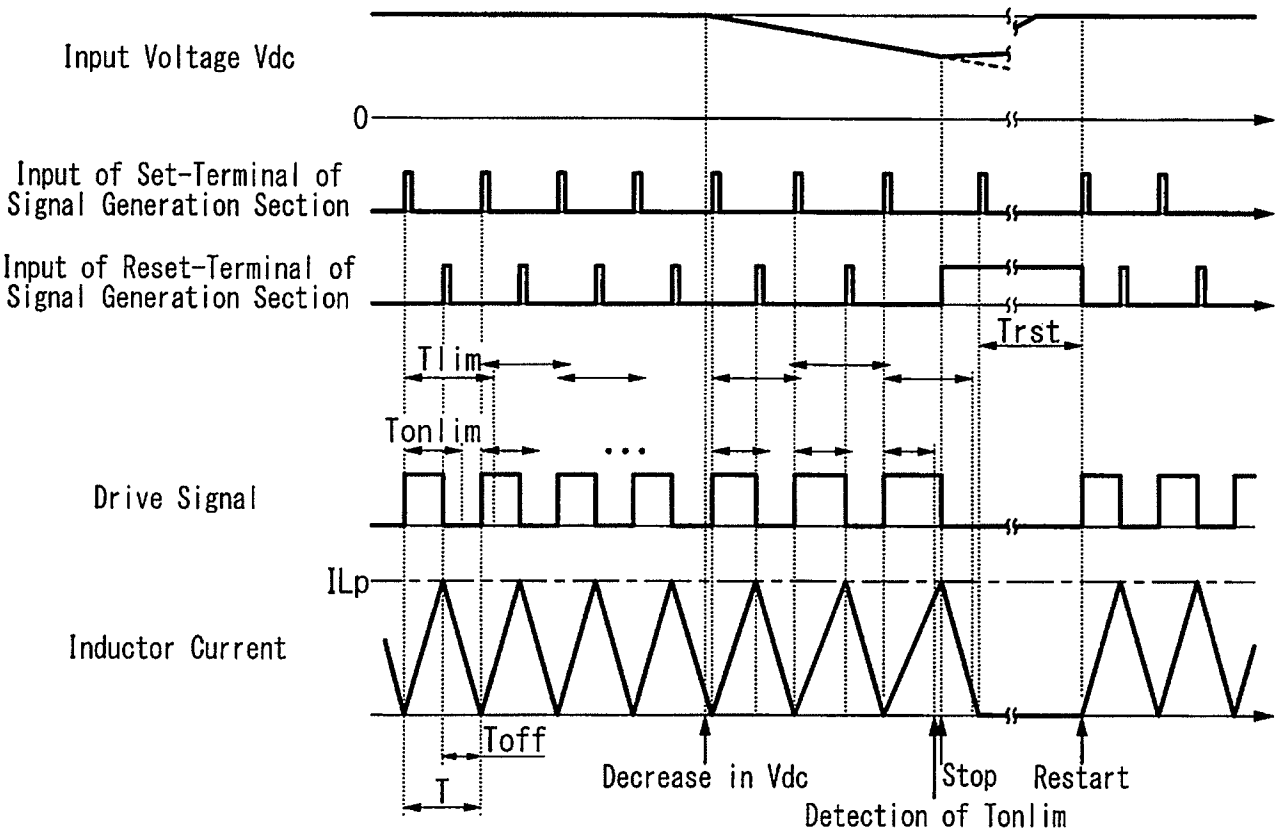
FIG. 10 is a time chart for illustrating an operation of the solid-state light-emitting element drive device and the lighting system according to the fourth embodiment.

As shown in FIG. 9, a control circuit 2 of the embodiment includes, in a judging section 22: an upper limit timer (not shown) having a delay time that is equal to an upper limit Tonlim of an ON-period Ton; an AND gate (a second AND gate; not shown) calculating a logical product (AND) of output of the upper limit timer and output of a signal generation section 20; and a latch circuit (not shown) of an RS flip flop. The judging section 22 further includes a cycle timer (not shown) having a delay time that is equal to an upper limit Tlim of a switching cycle T; and an AND gate (a third AND gate; not shown) calculates a logical product (AND) of output of the cycle timer and output of a triggering section 21. Note that, the upper limit Tlim of the cycle T is set smaller than a sum of the upper limit Tonlim of the ON-period Ton and an OFF-period Toff measured in a condition of no defect in connection.

An operation of the embodiment will be described with reference to FIG. 10.

When receiving the high-level signal from an OR gate 27 through a set-terminal, a signal generation section 20 raises an output signal thereof into a high-level to turn on a switching element Q1.

In a normal condition, output of a comparator 23 rises into a high-level before output of the upper limit timer of the judging section 22 rises into a high-level (i.e., before the delay time equal to the upper limit Tonlim elapses). In this time, the output signal (drive signal) of the signal generation section 20 is lowered, and thereby the switching element Q1 is turned off. Note that, if the drive signal is lowered into a low-level before the delay time (=the upper limit Tonlim) elapse, the upper limit timer is reset when the drive signal is lowered.

On the contrary, if there is a defect in connection or there is a decrease in an input DC voltage Vdc, the output of the upper limit timer in the judging section 22 rises into the high-level before the output of the comparator 23 rises into the high-level. In this case, output of the second AND gate is raised into a high-level, output of the latch circuit is raised into (and kept at) a high-level, and thereby output of the judging section 22 toward the OR gate 24 is raised into (and kept at) a high-level. Accordingly, the switching element Q1 is turned off.

Incidentally, even if there is a decrease in the input DC voltage Vdc, a peak value ILp of an inductor current and an output voltage Vo are kept constant, and accordingly the OFF-period Toff is kept constant. Therefore, in a case where "a decrease in the input DC voltage Vdc" causes the output of the upper limit timer to rise prior to the rise of the output of the comparator 23, the output of the signal generation section 21 is raised after the rise of the output of the cycle timer. Here, the cycle timer is configured to keep the output at a high-level after the delay time elapses. As a result, output of the third AND gate is raised into a high-level when the output of the triggering section 21 is raised into a high-level. An output terminal of the third AND gate is connected, through a delay circuit having a delay time Trst, to a reset-terminal of the latch circuit (RS flip flop) in the judging section 22 and a restart section 26. Therefore, after the output of the third AND gate rises into the high-level, the judging section 22 lowers the output signal toward the OR gate 24 when a predetermined restart time Trst elapses (see FIG. 10). The judging section 22 transmits a high-level signal to the restart section 26 when the restart time Trst, and thereby the restart section 26 transmits a restart signal. When receiving the restart signal, the second OR gate 27 transmits a high-level signal, and thereby the drive circuit 10 turns the switching element 10 on again to restart the switching regulator 1 (see FIG. 10).

On the other hand, if there is a defect in connection, the output voltage Vo becomes larger compared with a case where there is no defect in connection, and therefore an OFF-period Toff becomes smaller compared with the case where there is no defect in connection as is understood from the (Formula 9). Therefore, in a case where "a defect in connection" causes the output of the upper limit timer to rise prior to the rise of the output of the comparator 23, the output of the signal generation section 21 is raised before the rise of the cycle timer. Therefore, output of the third AND gate is kept at a low-level, and accordingly the judging section 22 keeps the output signal toward the restart section 26 at the low-level even when the restart time Trst elapses. As a result, the switching element Q1 is kept turned off to keep the switching regulator 1 turned off (i.e., to terminate the operation of the switching regulator 1).

As described above, in the embodiment, the control circuit 2 does not terminate the operation of the switching regulator 1 in a case where the switching cycle T is out of a predetermined range, even if the inductor current does not reach the peak value ILp when the ON-period Ton reaches the upper limit Tonlim. Accordingly, it is possible to prevent the switching regulator 1 from being wrongly halted for a long time due to a wrong decision made by the control section 2 about presence of a defect in connection caused by a fluctuation of the input voltage Vdc of the switching regulator 1.

In the above example, the cycle T is judged (i.e., is made comparison with the upper limit Tlim) after the decision of interruption of the driving signal (i.e., after decided that an ON-period Ton is larger than the Tonlim), but the embodiment is not limited to this configuration. For example, the judgment about the cycle T may be performed before the judgment about an ON-period Ton as follows.

That is, the control circuit 2 has a threshold TonlimA which is smaller than the upper limit Tonlim. Then, a switching cycle is judged (e.g., is compared with a threshold TlimA which is smaller than the upper limit Tlim) when an ON-period Ton reaches to the threshold TonlimA. And then, transmission of the drive signal is terminated when an ON-period Ton reaches the upper limit Tonlim, and it is determined whether the drive signal is kept turned off or is restarted based on the judged result (i.e., compared result with the threshold TlimA) about the cycle T.

In the third and fourth embodiments, the control circuit 2 may be configured to restart the drive signal plural times, and terminate the operation if the control circuit 2 judges that there is a defect in connection several times.

Fifth Embodiment

Figure 11:
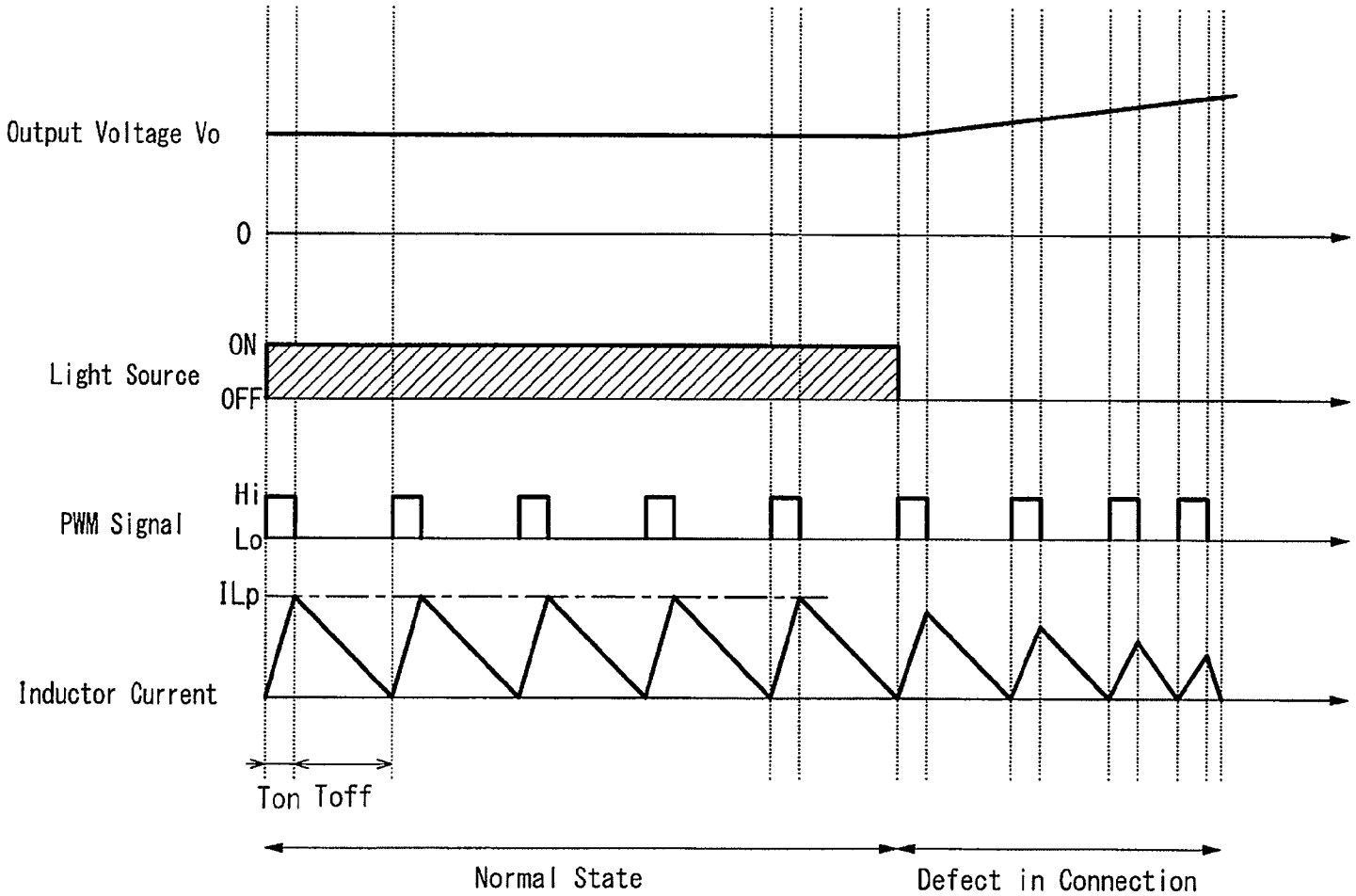
FIG. 11 is a time chart for illustrating an operation of a solid-state light-emitting element drive device (an LED drive device) and a lighting system according to fifth embodiment of the invention.

A lighting system and an LED drive device of fifth embodiment are described with reference to FIGS. 11 to 13.

Figure 12:
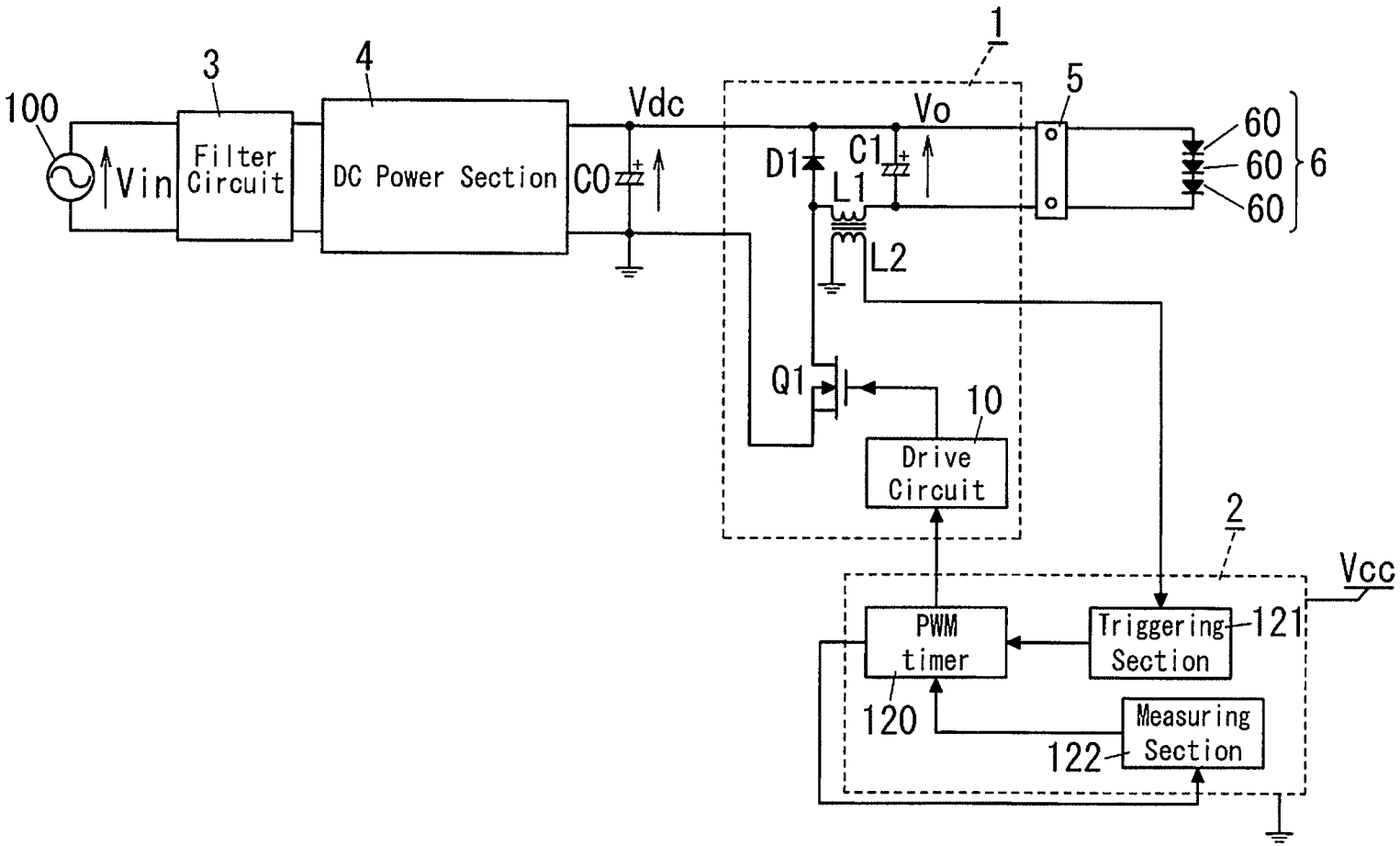
FIG. 12 is a circuit configuration diagram showing the solid-state light-emitting element drive device and the lighting system according to the fifth embodiment.
Figure 13:
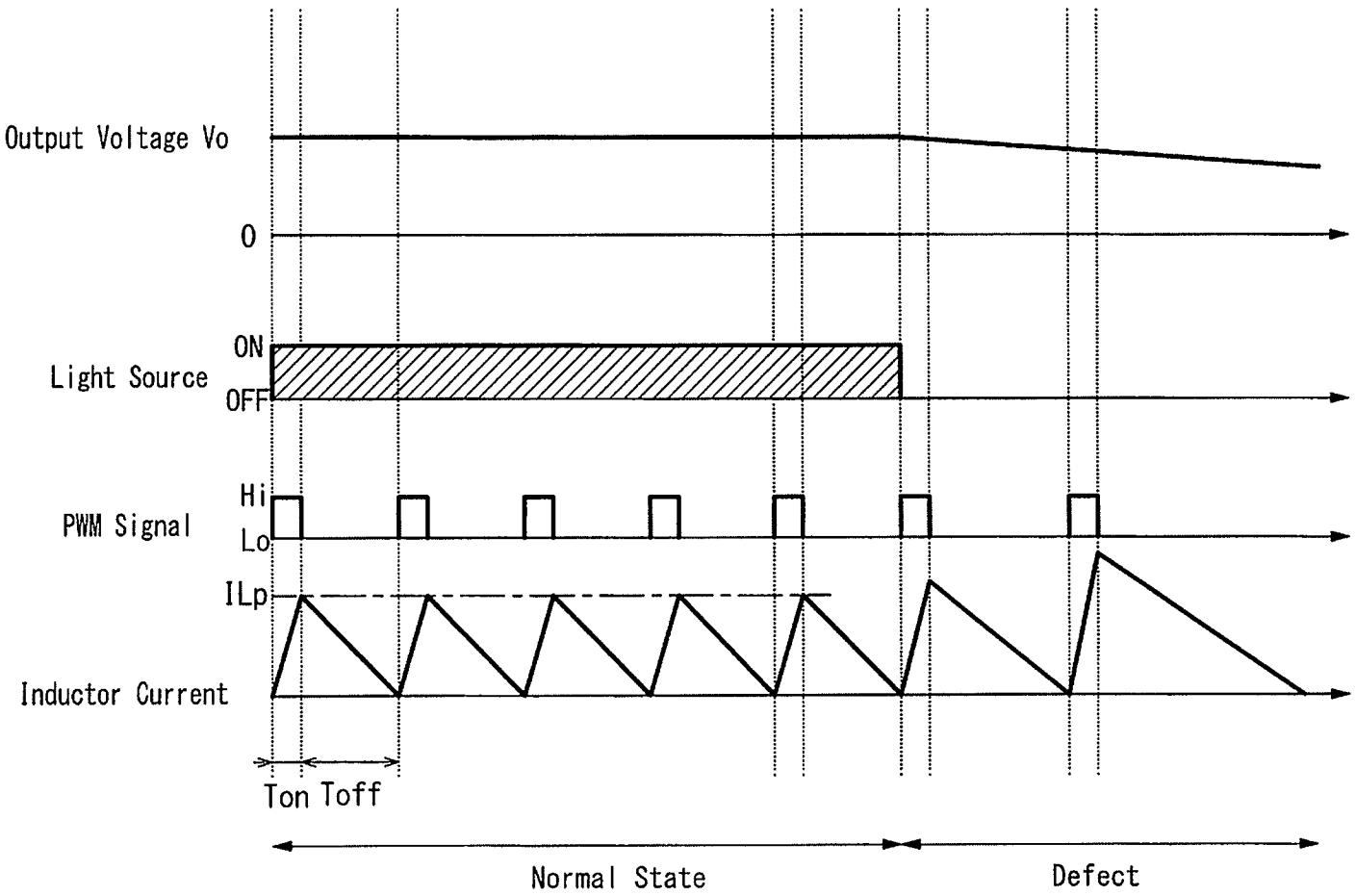
FIG. 13 is a time chart for illustrating an operation of a solid-state light-emitting element drive device and a lighting system of another configuration according to the fifth embodiment.

As shown in FIG. 12, the lighting system of the embodiment includes: a light source 6; and the LED drive device. The light source 6 includes a plurality of LEDs 60 that are connected in series with each other. The LED drive device of the embodiment is configured to convert AC power supplied from a commercial AC power source 100 into DC power to drive (light; power) the light source 6.

The LED drive device of the embodiment includes a switching regulator 1 and a control circuit 2. The LED drive device of the embodiment further includes a filter circuit 3, a DC power section 4, and a connector 5. The filter circuit 3 is adapted to remove a harmonic noise superimposed on an AC voltage/current of the AC power source 100. The DC power section 4 is formed of, for example, a full-wave rectifier (such as a diode bridge) for rectifying the AC voltage/current filtered by the filter circuit 3, or a combination of the full-wave rectifier and a boost chopper for correcting power factor. The boost chopper for correcting power factor is already known, and therefore is not described in detail about the circuit configuration and the operation thereof. The light source 6 is connected between output terminals of the switching regulator 1 via the connector 5.

A smoothing capacitor C0 is connected between output terminals of the DC power section 4 to smooth the output voltage of the DC power section 4, and the DC voltage "Vdc" generated across the smoothing capacitor C0 is applied across input terminals of the switching regulator 1. The switching regulator 1 is formed of a step-down chopper that includes a switching element Q1, a diode D1, an inductor L1, a smoothing capacitor C1, and a drive circuit 10. The switching element Q1 is a field-effect transistor (FET). The switching element Q1 has: a drain that is connected to an anode of the diode D1; and a source that is connected to a low-voltage side input terminal of the smoothing capacitor C0. The inductor L1 has: a first end that is connected to a connection point of the anode of the diode D1 and the drain of the switching element Q1; and a second end that is connected to a low-voltage side terminal of the smoothing capacitor C1. The smoothing capacitor C1 is connected between the second end of the inductor L1 and a cathode of the diode D1. The connector 5 is connected to both output terminals of the smoothing capacitor C1 (i.e., connected to the output terminals of the switching regulator 1). A secondary winding L2 is provided so as to be electromagnetically coupled with the inductor L1. The secondary winding L2 has a first end that is connected to a circuit ground and a second end that is connected to an input port of the control circuit 2.

The drive circuit 10 turns on the switching element Q1 by applying a bias voltage to a gate of the switching element Q1 when a drive signal supplied from the control circuit 2 is at a high-level, and turns off the switching element Q1 by not applying the bias voltage when the drive signal is at a low-level.

The control circuit 2 is formed of a microcomputer including a timer (a PWM timer; a signal generation section) 120 that generates a PWM (pulse width modulation) signal of which pulse width is variable. An output signal (the PWM signal) of the PWM timer 120 is supplied to the drive circuit 10 as the drive signal. The control circuit 2 further includes a triggering section 121. The triggering section 121 resets to restart the PWM timer 120 by transmitting a high-level signal to the PWM timer 120 when detecting a zero-cross of a voltage induced across the secondary winding L2 (i.e., detecting a zero-cross of an inductor current flowing through the inductor L1) via the input port. The PWM timer 120 switches the level of the output signal (drive signal) into a high-level when receiving the high-level signal from the triggering section 121, and then switches the level of the output signal (drive signal) into a low-level at a point in time when a predetermined ON-time elapses.

Therefore, the control circuit 2 controls the switching element Q1 according to so-called "critical current mode", in which the switching element Q1 is turned on when all of the energy stored in the inductor L1 during an ON-period of the switching element Q1 is emitted.

The control circuit 2 further includes a measuring section 122 configured to acquire therein an output signal of the PWM time 120 to measure a period of time during which the output signal is at the high-level (the high-level period) or a period of time during which the output signal is at the low-level (the low-level period).

A control operation of the switching regulator 1 by the control circuit 2 will be described. As shown in FIG. 1, in the switching regulator 1, a current (an inductor current) flowing through the inductor L1 linearly increases during an ON-period of the switching element Q1, and linearly decreases during an OFF-period of the switching element Q1. According to the critical current mode, "a peak value ILp of the current (the inductor current) through the inductor L1" and "a mean value Io of an output current of the switching regulator 1 during one cycle of the switching element Q1" satisfies the formula below:

$$ILp=2Io \quad \text{(Formula 15).}$$

Also, as described above, the peak value "ILp" of the inductor current is expressed in the (Formula 1):

$$ILp=Ton*(Vdc-Vo)/L \quad \text{(Formula 1).}$$

By substituting the (Formula 15) into the (Formula 1), it is obtained the formula below:

$$Io=Ton*(Vdc-Vo)/2L \quad \text{(Formula 16).}$$

The output voltage Vo of the switching regulator 1 is, usually, equivalent to a rated voltage (=product of "a forward voltage of the LED 60" and "the number of the LED 60") of the light source 6, and is kept constant under a condition where the light source 6 is supplied with a constant current. Accordingly, in a case where the output voltage Vdc of the DC power section 4 is stable sufficiently, it is possible to obtain a desired output voltage Vo and output current Io from the switching regulator 1 by setting a high-level period of the output signal (PWM signal) of the PWM timer 120 to a specified ON-period Ton obtained by the (Formula 16).

According to the critical current mode, the peak value ILp of the inductor current and an OFF-period Toff of the switching element Q1 satisfies the formula below:

$$ILp=Toff*Vo/L \quad \text{(Formula 17).}$$

By substituting the (Formula 17) into the (Formula 1), it is obtained the formula below:

$$Ton/Toff=Vo/(Vdc-Vo) \quad \text{(Formula 18).}$$

Therefore, if the LED drive device operates normally to supply a rated voltage/current to the light source 6, a ratio of the ON-period Ton to the OFF-period Toff (i.e., Ton/Toff) is kept in a prescribed range to be kept substantially constant, because the output voltage Vdc of the DC power section 4 and the output voltage Vo of the switching regulator 1 are kept constant.

On the other hand, if the light source 6 is disconnected from the connector 5 (no-load state) or the light source 6 is incompletely connected to the connector 5 (loose-contact state), it causes an increase in the output voltage Vo of the switching regulator 1. In such the state, because the denominator of the right side in the (Formula 18) decreases and the numerator thereof increases, the ratio (Ton/Toff) increases and to be out of a prescribed range. Note that, because the high-level period of the output signal of the PWM timer 120 is kept constant in the embodiment, the OFF-period Toff decreases (changes) without the ON-period Ton being changed (see FIG. 11).

In this regard, the control circuit 2 measures a period (low-level period) of time during which the PWM timer 120 transmits an output signal with a low-level by means of the measuring section 122, and compares the measured period with a low-level period obtained under a condition where the light source 6 is normally (correctly) connected with the connector 5. The control circuit 2 is configured to decide that the ratio (Ton/Toff) is out of the prescribed range, i.e., to decide presence of a defect in connection between the connector 5 and the light source 6, if detecting that the measured low-level period with the measuring section 122 is smaller than the low-level period of a normal state.

Note that, the measuring section 122 may be configured to measure a period of time between adjacent rising points in time of the drive signal (i.e., a period of an ON-period Ton and an OFF-period Toff; a switching cycle T), instead of measuring the low-level period. In this case, the control section 2 decides presence of a defect in connection if detecting that the measured period (the cycle T) is smaller than a value in a normal state. When deciding presence of a defect in connection, the control circuit 2 e.g., adjusts the PWM timer 120 to decrease a rate of the ON-period Ton (i.e., to decrease a duty ratio) of the switching element Q1. Accordingly, it is possible to suppress the increase in the output voltage Vo of the switching regulator 1.

As described above, in the embodiment, the control circuit 2 is configured: to turn on the switching element Q1 when the regenerative current is equal to or less than a predetermined threshold; and also to turn off the switching element Q1 when a predetermined ON-time elapses. The control circuit 2 is configured to suppress the output power of the switching regulator Q1 if a ratio (Ton/Toff) of the ON-period Ton to the OFF-period Toff is out of a prescribed range. According to the embodiment, it is possible to detect presence of a defect in connection without adding a monitoring means monitoring the output (voltage/current) of the switching regulator 1.

Note that, the control circuit 2 may be configured to store measured values of OFF-periods Toff and/or measured values of switching cycles T in a register of a microcomputer, and to determine whether or not there is a defect in connection based on temporal variations in the measured values.

Note that, in the embodiment, the control circuit 2 can suppress the output power of the switching regulator 1, not only in the case of a defect in connection between the connector 5 and the light source 6, but in a case of a reduction in the output voltage Vo of the switching regulator 1, based on the ratio (Ton/Toff) of the ON-period Ton to the OFF-period Toff. That is, the reduction in the output voltage Vo of the switching regulator 1 causes an increase in the OFF-period Toff (see FIG. 13), and accordingly causes a decrease in the ratio (Ton/Toff). The control circuit 2 detects the degree of decrease in the ratio (Ton/Toff), and suppresses the output power of the switching regulator 1 if the ratio (Ton/Toff) is out of a prescribed range.

Sixth Embodiment

Figure 14:
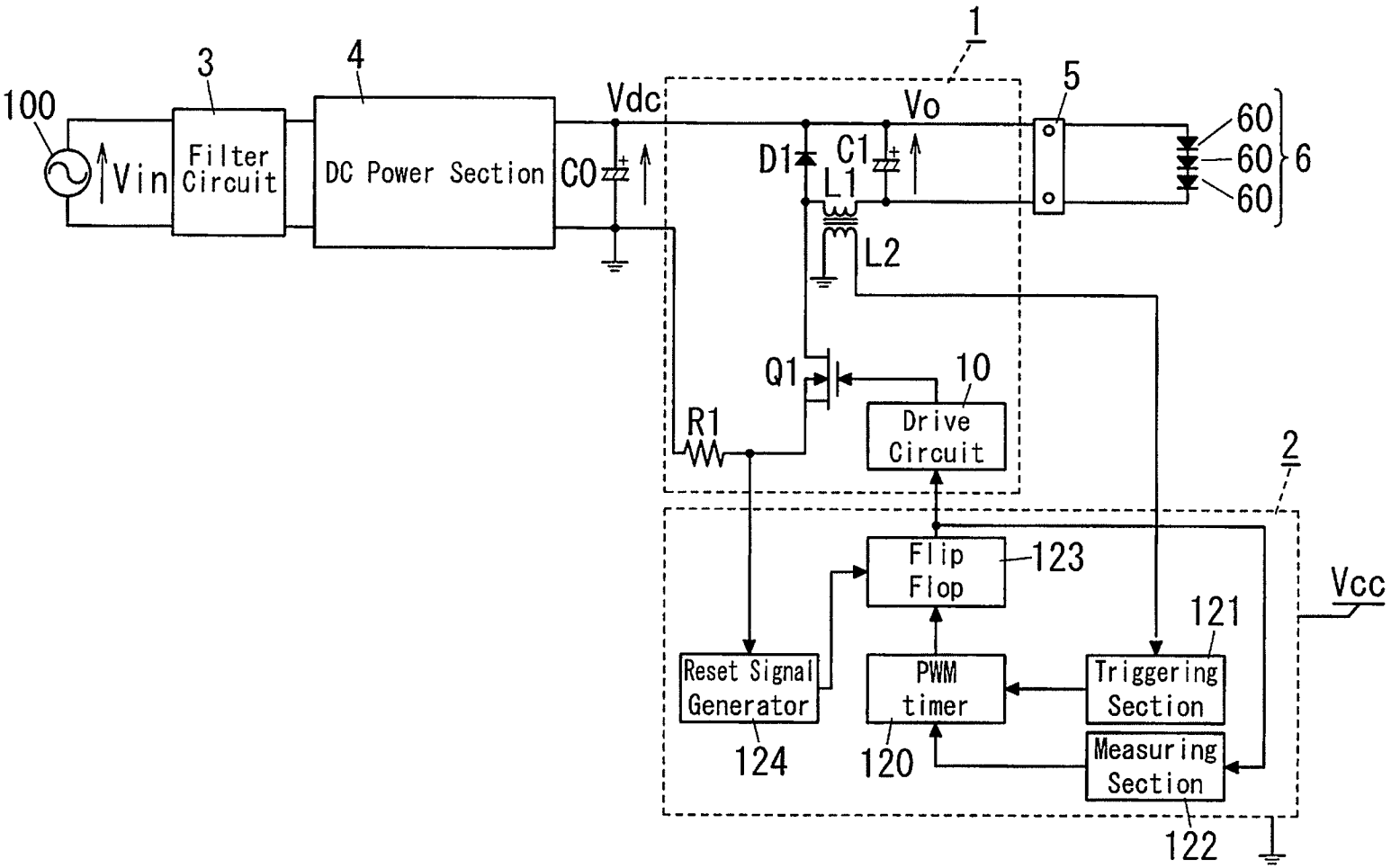
FIG. 14 is a circuit configuration diagram showing a solid-state light-emitting element drive device (an LED drive device) and a lighting system according to sixth embodiment of the invention.

A lighting system and an LED drive device of fourth embodiment are described with reference to FIGS. 14 to 16. FIG. 14 illustrates a circuit configuration diagram of the LED drive device and the lighting system of the embodiment. The embodiment has a basic configuration similar with the fifth embodiment, and therefore like elements are assigned the same reference signs as depicted in the fifth embodiment and not described in detail.

In the embodiment, a control circuit 2 further includes a flip flop 123 and a reset signal regenerator 124. In addition, a detection resistor R1 is connected between a low-voltage side terminal of a smoothing capacitor C0 and a source of a switching element Q1.

The flip flop 123 has a set-terminal and a reset-terminal. The flip flop 123 is configured: to raise an output signal thereof into a high-level when receiving an output signal with a high-level through the set-terminal from a PWM timer 120; and to lower the output signal thereof into a low-level when receiving a reset signal through the reset-terminal from the reset signal generator 124. The drive circuit 10 controls the switching operation of the switching element Q1 in response to output of the flip flop 123 as a drive signal.

The reset signal generator 124 detects (measures) an inductor current flowing through the switching element Q1 via the detection resistor R1, and generates the reset signal of one-shot pulse when the inductor current increases to reach a predetermined peak value ILp.

In the embodiment, when the drive signal of the flip flop 123 is raised into the high-level, the drive circuit 10 turns on the switching element Q1 to cause the inductor current to flow. When the inductor current reaches the peak value ILp, the reset signal generator 124 transmits the reset signal to lower the output signal (drive signal) of the flip flop 123 into the low-level, and accordingly the drive circuit 10 turns off the switching element Q1. After then, when all the energy stored in the inductor L1 is emitted (i.e., when the inductor current decreases to reach "0"), a triggering section 121 resets to restart the PWM timer 120. As a result, the output (drive signal) of the flip flop 123 is raised into the high-level, and the drive circuit 10 turns on the switching element Q1 to flow an inductor current again (see FIG. 15). In the embodiment therefore, in a case where an LED drive device operates normally to supply a rated voltage/current to a light source 6, a ratio of an ON-period Ton to an OFF-period Toff (i.e., Ton/Toff) is kept in a prescribed range to be kept substantially constant, because an output voltage Vdc of a DC power section 4 and an output voltage Vo of the switching regulator 1 are kept constant.

As described above, the ON-period Ton is expressed in the (Formula 2):

$$Ton=(L*ILp)/(Vdc-Vo) \quad \text{(Formula 2).}$$

Figure 15:
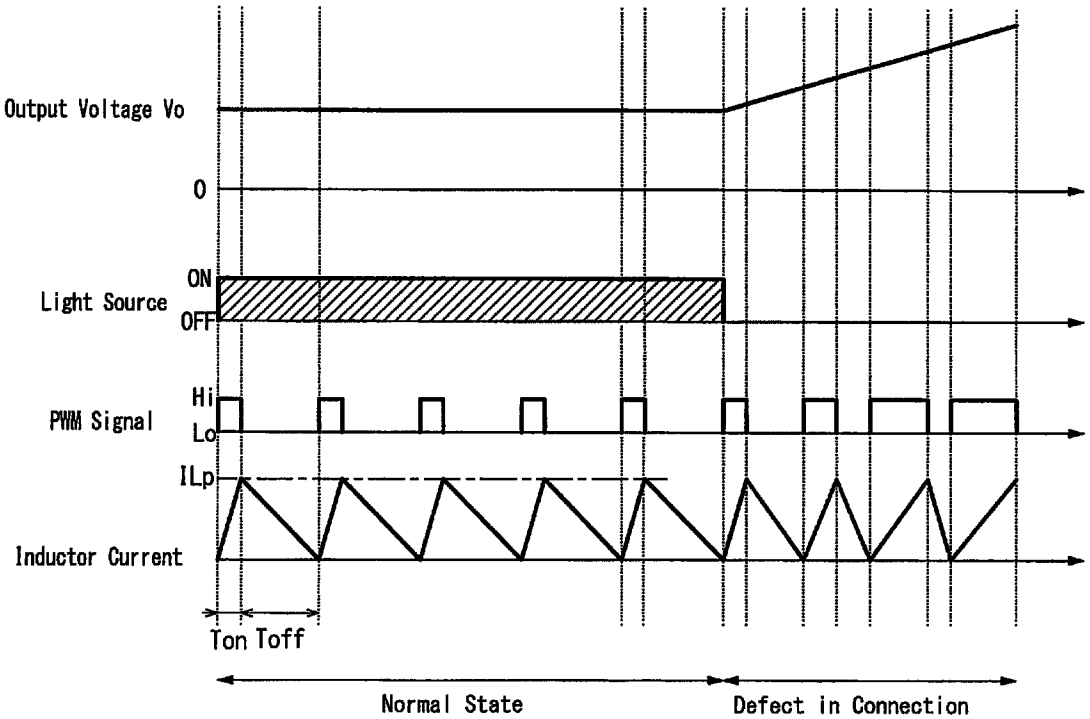
FIG. 15 is a time chart for illustrating an operation of the solid-state light-emitting element drive device and the lighting system according to the sixth embodiment.
Figure 16:
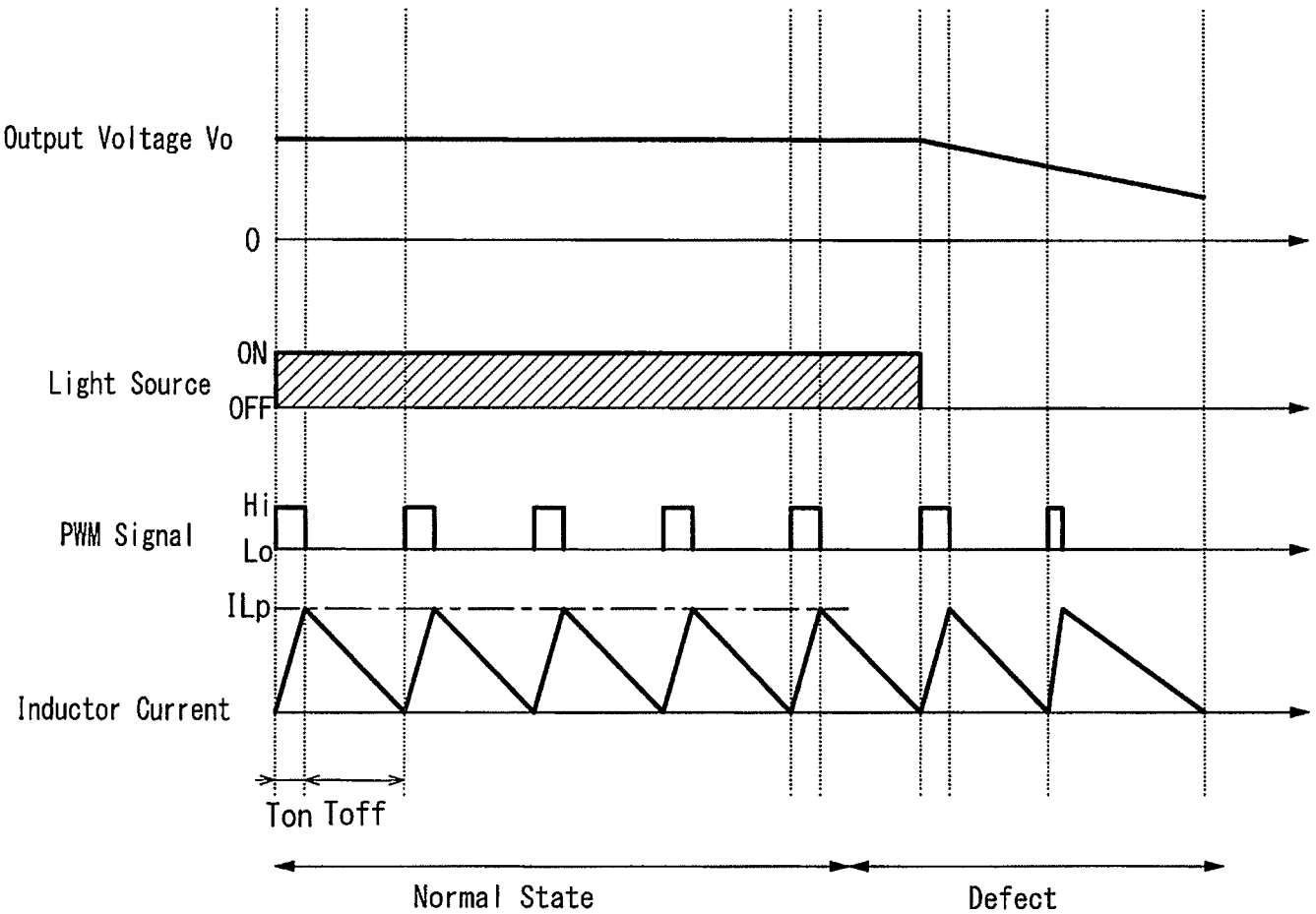
FIG. 16 is a time chart for illustrating an operation of a solid-state light-emitting element drive device and a lighting system of another configuration according to the sixth embodiment.

As is understood from the (Formula 2), in a case where the output voltage Vdc of the DC power section 4 is sufficiently stable, if the output voltage Vo of the switching regulator 1 increases due to a no-load state or a loose-contact state, it causes an increase in the ON-period Ton (i.e., causes an increase in a time required for reaching the inductor current to the peak value ILp) in comparison with a normal state (see FIG. 15).

As described above, the OFF-period Toff is expressed in the (Formula 9):

$$Toff=(L*ILp)/Vo \quad \text{(Formula 9)}$$

As is understood from the (Formula 9), in a case where the output voltage Vdc of the DC power section 4 is sufficiently stable, if the output voltage Vo of the switching regulator 1 increases due to a no-load state or a loose-contact state, it causes a decrease in the OFF-period Toff in comparison with a normal state (see FIG. 15).

Therefore, it is possible to decide presence of a defect in connection by measuring a low-level period and/or a high-level period of the drive signal (which is provided from the flip flop 123 to the drive circuit 10). The control circuit 2 is configured, for example, to decide presence of a defect in connection when the measured value is out of a threshold, and/or a value obtained from monitored values of temporal variations exceeds a predetermined value. That is, the measuring section 122 may be configured to terminate the operation of the PWM timer 120 when the ratio (Ton/Toff) of the ON-period Ton to the OFF-period Toff is out of a prescribed range.

As described above, in the embodiment, the control circuit 2 is configured: to turn on the switching element Q1 when the regenerative current is equal to or less than a predetermined threshold; and also to turn off the switching element Q1 when the inductor current through the inductor L1 is equal to or more than a predetermined peak value ILp (i.e., the electric current through the switching element Q1 is equal to or more than a predetermined peak value). The control circuit 2 is configured to suppress the output power of the switching regulator Q1 if a ratio (Ton/Toff) of the ON-period Ton to the OFF-period Toff is out of a prescribed range. According to the embodiment, it is possible to detect presence of a defect in connection without adding a monitoring means monitoring the output (voltage/current) of the switching regulator 1.

Note that, in the embodiment, the control circuit 2 can suppress the output power of the switching regulator 1, not only in the case of a defect in connection between the connector 5 and the light source 6, but in a case of a reduction in the output voltage Vo of the switching regulator 1, based on the ratio (Ton/Toff) of the ON-period Ton to the OFF-period Toff. That is, the reduction in the output voltage Vo of the switching regulator 1 causes a decrease in the ON-period Ton and an increase in the OFF-period Toff (see FIG. 16), and accordingly causes a decrease in the ratio (Ton/Toff). The control circuit 2 detects the degree of decrease in the ratio (Ton/Toff), and suppresses the output power of the switching regulator 1 if the ratio (Ton/Toff) is out of a prescribed range.

Seventh Embodiment

Figure 17:
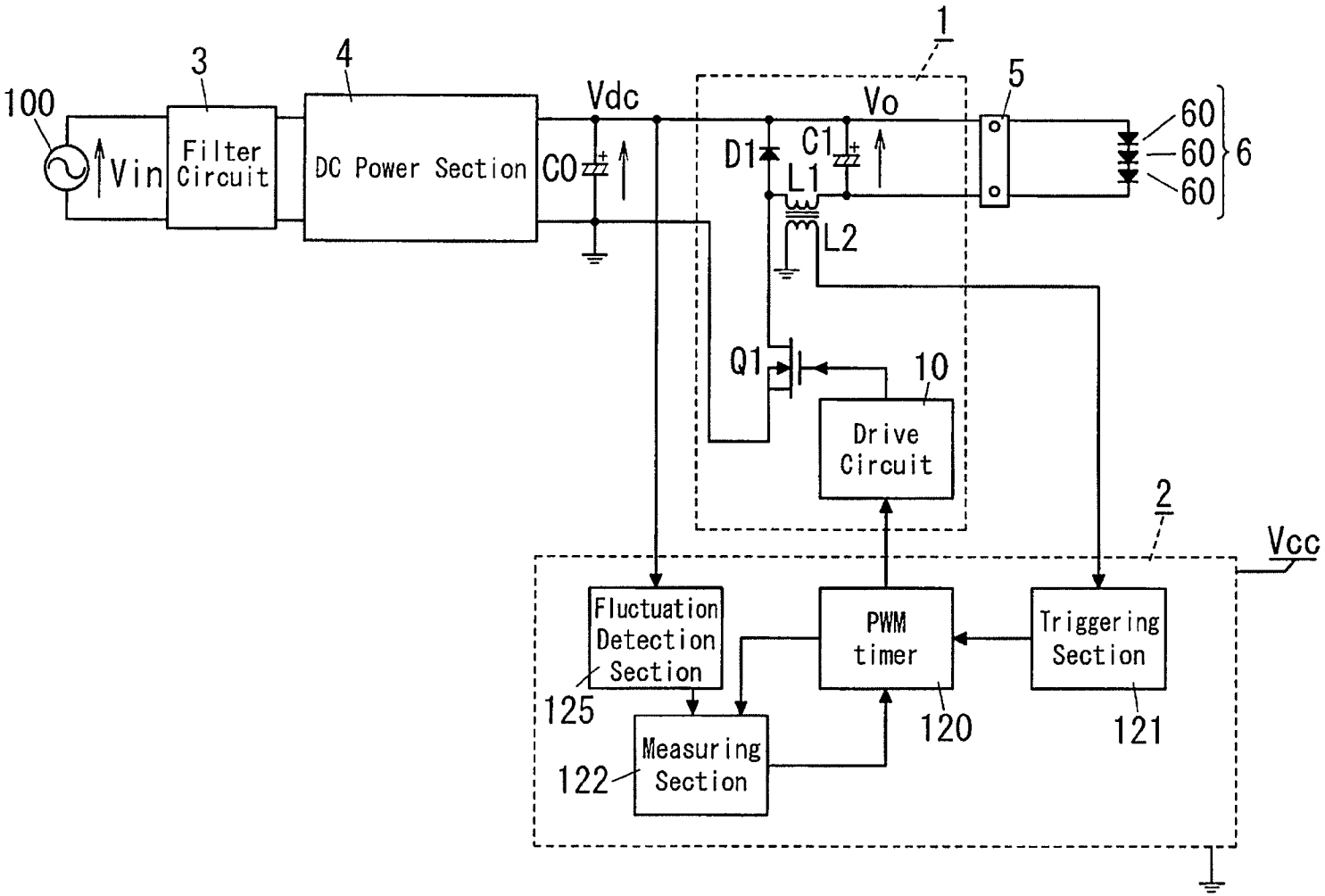
FIG. 17 is a circuit configuration diagram showing a solid-state light-emitting element drive device (an LED drive device) and a lighting system according to seventh embodiment of the invention.

A lighting system and an LED drive device of seventh embodiment are described with reference to FIG. 17. FIG. 17 illustrates a circuit configuration diagram of the LED drive device and the lighting system of the embodiment. The embodiment has a basic configuration similar with the fifth embodiment, and therefore like elements are assigned the same reference signs as depicted in the fifth embodiment and not described in detail.

The fifth embodiment is described under the premise that a DC power section 4 supplies a switching regulator 1 with a sufficiently stable DC voltage Vdc. However, because the DC voltage Vdc is obtained by converting the AC voltage Vin of a commercial AC power source 100, there is a concern that the DC voltage Vdc includes a fluctuation due to a ripple component of which frequency is twice the power-supply frequency of the AC voltage source 100. In addition, if the AC input voltage Vin fluctuates within a short time, there is a possibility that the DC voltage Vdc also fluctuates within a short time according to responsiveness of the DC power section 4. If the DC voltage Vdc has a fluctuation component, a ratio of an ON-period Ton to an OFF-period Toff also fluctuates, as is understood from the (Formula 18). In this case, there is a concern that a control circuit 2 makes a wrong decision of presence of a defect in connection.

In this regard, the control circuit 2 of the embodiment further includes a fluctuation detection section 125 configured to detect presence of fluctuation in the input voltage Vdc. The fluctuation detection section 125 acquires therein the input voltage Vdc of the switching regulator 1, and transmits a detection signal toward the measuring section 122 when the monitored value of the fluctuation of the input voltage Vdc exceeds a threshold. The control circuit 2 is configured not to determine whether or not there is a defect in connection when the detection signal is transmitted from the fluctuation detection section 125.

The embodiment therefore can prevent from making a wrong decision made by the control section 2 about presence of a defect in connection caused by the fluctuation of the input voltage Vdc of the switching regulator 1.

The fifth to the seventh embodiments are described based on a configuration configured to control the switching regulator (step-down chopper) 1 according to the critical current mode, but the embodiments are not limited to this configuration. The switching regulator 1 may be formed of other circuit than the step-down chopper, and/or may be controlled according to the continuous current mode or the discontinuous current mode as described in the first and second embodiments. In the fifth to the seventh embodiments, the AC power source 100 and the DC power section 4 may be replaced with a DC power source such as a storage battery for supplying DC power to the switching regulator 1.

Eighth Embodiment

A lighting fixture of the embodiment is described with reference to FIG. 18. The lighting fixture 30 of the embodiment includes: an LED drive device as described in any of the above embodiment; a light source 6 (solid-state light-emitting element) to be driven with the LED drive device; and a fixture body (32, 35) holding the LED drive device and the light source 6.

Figure 18:
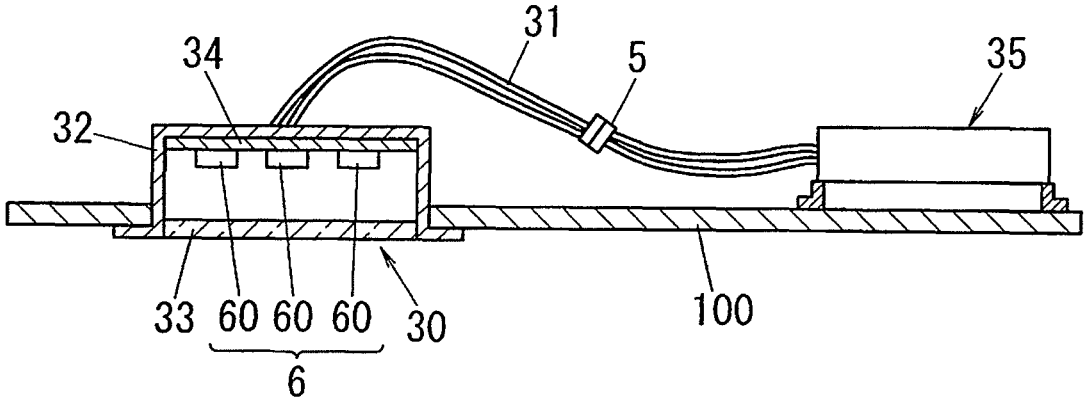
FIG. 18 is a schematic view of a lighting fixture according to eighth embodiment of the invention.

As shown in FIG. 18, in the lighting fixture 30, the LED drive device is accommodated in a casing 35 which is separated from a housing 32 in which the light source 6 is housed. The LED drive device is connected to the light source 6 through a lead wire 31. Therefore, the lighting fixture 30 can implement the slimness of the light source 6 and increase the degree of freedom of the installation place of the LED drive device.

In the example of FIG. 18, the housing 32 is made of metal material, and is shaped like a cylinder having an upper base and an opened bottom. The opened surface (the bottom surface) is covered with a light diffusing sheet 33. According to the light source 6, a plurality of (herein, three) LEDs 60 are mounted on one surface (lower surface) of a substrate 34 and are disposed inside the housing 32 so as to face the light diffusing sheet 33. The housing 32 is provided to be buried in a ceiling 100 and is connected to the LED drive device disposed behind the ceiling 100 through the lead wires 31 and connectors 5.

Note that, the lighting fixture 30 is not limited to a separate mounting type configuration in which the LED drive device is accommodated in the casing which is separated from the casing for the light source 6. For example, the lighting fixture 30 may be a power supply integrated type configuration in which the light source 6 and the LED drive device are housed in a single casing.

The LED drive device is not limited to be used for the lighting fixture 30. The LED drive device may be used for various light sources, for example, a backlight of a liquid crystal display, a copier, a scanner, a projector, and the like.

The invention claimed is:

1. A solid-state light-emitting element drive device, comprising:

a switching regulator comprising a series circuit of a switching element and an inductor, a regenerative element configured to allow a regenerative current to flow therethrough from the inductor when the switching element is turned off, and output terminals configured so that a solid-state light-emitting element is connected therebetween; and a control circuit configured to control a switching operation of the switching element of the switching regulator, wherein the control circuit is configured: to turn off the switching element when an electric current through the switching element or the inductor is equal to or more than a predetermined peak value; and also to turn on the switching element when the regenerative current is equal to or less than a predetermined threshold, and the control circuit is configured to suppress the output power of the switching regulator if a time period exceeds a prescribed upper limit, said time period being the switching element's ON period, OFF-period, or a switching cycle of the ON-period and the OFF period.

2. The solid-state light-emitting element drive device as set forth in claim 1, wherein the control circuit is configured to suppress the output power of the switching regulator if the current through the switching element or the inductor does not reach the peak value when the ON-period reaches the upper limit.

3. The solid-state light-emitting element drive device as set forth in claim 2, wherein the control circuit is configured not to terminate an operation of the switching regulator in a case where the OFF-period is in a predetermined range, even if the current through the switching element or the inductor does not reach the peak value when the ON-period reaches the upper limit.

4. The solid-state light-emitting element drive device as set forth in claim 1, wherein the control circuit is configured to suppress the output power of the switching regulator if the regenerative current does not reach the threshold when the OFF-period or the cycle reaches the upper limit.

5. The solid-state light-emitting element drive device as set forth in claim 1, further comprising a signal generation section configured to generate a PWM signal, wherein the PWM signal generated with the signal generation section is synchronized with a drive signal of the switching element.

6. The solid-state light-emitting element drive device as set forth in claim 5, wherein the control circuit is formed of a microcomputer including a built-in timer, and the PWM signal is generated through the timer.

7. The solid-state light-emitting element drive device as set forth in claim 6, wherein the control circuit is configured to monitor temporal variations in ON-periods, OFF-periods, or cycles, by measuring the output of the timer, and to suppress the output power of the switching regulator if a value obtained from monitored values of the temporal variations exceeds a predetermined value.

8. A solid-state light-emitting element drive device, comprising:

a switching regulator comprising a series circuit of a switching element and an inductor, a regenerative element configured to allow a regenerative current to flow therethrough from the inductor when the switching element is turned off, and output terminals configured so that a solid-state light-emitting element is connected therebetween; and a control circuit configured to control a switching operation of the switching element of the switching regulator, wherein the control circuit is configured: to turn on the switching element when the regenerative current is equal to or less than a predetermined threshold; and also to turn off the switching element when a predetermined ON-time elapses or an electric current through the switching element is equal to or more than a predetermined peak value; and the control circuit is configured to suppress the output power of the switching regulator if a ratio of the ON-period to the OFF-period is out of a prescribed range.

9. The solid-state light-emitting element drive device as set forth in claim 8, wherein the ON-period is a period of time during which the electric current through the inductor increases while the switching element is turned on, and the OFF-period is a period of time during which the regenerative current decreases while the switching element is turned off.

10. The solid-state light-emitting element drive device as set forth in claim 9, wherein the control circuit is configured to decrease the ON-period or a rate of the ON-period if the ratio is out of the prescribed range.

11. The solid-state light-emitting element drive device as set forth in claim 8, wherein the control circuit is configured to determine whether or not the ratio is out of the prescribed range based on temporal variations in OFF-periods.

12. The solid-state light-emitting element drive device as set forth in claim 8, wherein the control circuit is configured to determine whether or not the ratio is out of the prescribed range based on temporal variations in ON-periods.

13. The solid-state light-emitting element drive device as set forth in claim 8, wherein the control circuit is configured not to determine whether or not the ratio is out of the prescribed range when an input voltage of the switching regulator is out of a predetermined range.

14. The solid-state light-emitting element drive device as set forth in claim 8, further comprising a signal generation section configured to generate a PWM signal, wherein the PWM signal generated with the signal generation section is synchronized with a drive signal of the switching element.

15. The solid-state light-emitting element drive device as set forth in claim 14, wherein at least one of the ON-period and the OFF-period substantially agrees with a high-level period or a low-level period of the PWM signal generated by the signal generation section, and the control circuit is configured to determine whether or not the ratio is out of the prescribed range based on temporal variations in high-level periods or low-level periods.

16. The solid-state light-emitting element drive device as set forth in claim 14, wherein the control circuit is formed of a microcomputer including a built-in timer and configured to generate the PWM signal through the timer.

17. The solid-state light-emitting element drive device as set forth in claim 16, wherein the control circuit is configured to monitor the temporal variations in high-level periods or low-level periods, and to suppress the output power of the switching regulator if a value obtained from monitored values of the temporal variations exceeds a predetermined value.

18. A lighting system comprising:

the solid-state light-emitting element drive device as set forth in claim 1; and a solid-state light-emitting element configured to be driven through the solid-state light-emitting element drive device.

19. A lighting fixture comprising:

the solid-state light-emitting element drive device as set forth in claim 1;

a solid-state light-emitting element configured to be driven through the solid-state light-emitting element drive device; and a fixture body holding the solid-state light-emitting element drive device and the solid-state light-emitting element.

* * * * *